US010960261B2

(12) United States Patent
Liao et al.

(10) Patent No.: US 10,960,261 B2
(45) **Date of Patent: *Mar. 30, 2021**

(54) STATIONARY EXERCISE APPARATUS

(71) Applicant: Johnson Health Tech Co., Ltd., Taichung (TW)

(72) Inventors: Hung-Mao Liao, Cottage Grove, WI (US); Mark J. Kannel, Oconomowoc, WI (US); Donald E. Stiemke, Madison, WI (US); Darian P. Johnston, Madison, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/454,333

(22) Filed: Jun. 27, 2019

(65) Prior Publication Data

US 2019/0314673 A1 Oct. 17, 2019

Related U.S. Application Data

(63) Continuation of application No. 15/095,901, filed on Apr. 11, 2016, now Pat. No. 10,369,403, which is a (Continued)

(30) Foreign Application Priority Data

Nov. 4, 2005 (CN) ..... 200510115518.0
Jul. 27, 2006 (CN) ..... 200610103811.X

(51) Int. Cl.
*A63B 22/00* (2006.01)
*A63B 21/22* (2006.01)
(Continued)

(52) U.S. Cl.
CPC ..... *A63B 22/001* (2013.01); *A63B 21/225* (2013.01); *A63B 21/4034* (2015.10);
(Continued)

(58) Field of Classification Search
CPC . A63B 22/001; A63B 21/4034; A63B 21/225; A63B 24/00; A63B 22/04;
(Continued)

(56) References Cited

U.S. PATENT DOCUMENTS 5,383,829 A 1/1995 Miller
5,540,637 A 7/1996 Rodgers, Jr.
(Continued)

FOREIGN PATENT DOCUMENTS

CN 2559371 Y 7/2003
CN 2571426 Y 9/2003
(Continued)

OTHER PUBLICATIONS

PCT/IB06/003669, IPRP & Written Opinion dated May 15, 2008, ISR & Written Opinion dated Nov. 29, 2007, 22 pages.
(Continued)

*Primary Examiner* — Garrett K Atkinson
(74) *Attorney, Agent, or Firm* — Smith Law Office; Jeffry W. Smith

(57) ABSTRACT

A stationary exercise device having variable footpaths is disclosed. The exercise device includes a frame, a pair of supporting members that have a first end to rotate about an axis and a second end to move along a reciprocating path, a pair of pedals joined to the supporting members, and a guider assembly for adjusting an incline angle of the reciprocating path.

12 Claims, 23 Drawing Sheets

Related U.S. Application Data continuation of application No. 13/782,798, filed on Mar. 1, 2013, now Pat. No. 9,339,684, which is a continuation of application No. 13/335,437, filed on Dec. 22, 2011, now Pat. No. 8,403,815, which is a continuation of application No. 12/773,849, filed on May 5, 2010, now Pat. No. 8,092,349, which is a continuation of application No. 11/497,783, filed on Aug. 2, 2006, now Pat. No. 7,722,505, which is a continuation-in-part of application No. 11/434,541, filed on May 15, 2006, now Pat. No. 7,682,290.

(51) Int. Cl.

| | |
|---|---|
| ***A63B 24/00*** | (2006.01) |
| ***A63B 22/06*** | (2006.01) |
| ***A63B 22/04*** | (2006.01) |
| ***A63B 21/00*** | (2006.01) |
| ***A63B 22/20*** | (2006.01) |

(52) U.S. Cl.

CPC ..... *A63B 22/0015* (2013.01); *A63B 22/0023* (2013.01); *A63B 22/04* (2013.01); *A63B 22/0664* (2013.01); *A63B 24/00* (2013.01); *A63B 21/00* (2013.01); *A63B 22/00* (2013.01); *A63B 22/205* (2013.01); *A63B 2022/067* (2013.01); *A63B 2022/0676* (2013.01); *A63B 2225/09* (2013.01)

(58) Field of Classification Search

CPC ..... A63B 22/0015; A63B 22/0023; A63B 22/0664; A63B 22/205; A63B 21/00; A63B 22/00; A63B 2022/067; A63B 2022/0676; A63B 2225/09

USPC ..... 482/51–57

See application file for complete search history.

(56) References Cited

U.S. PATENT DOCUMENTS 5,573,480 A 11/1996 Rodgers, Jr.
5,653,662 A 8/1997 Rodgers, Jr.
5,685,804 A 11/1997 Whan-Tong et al.
5,690,589 A 11/1997 Rodgers, Jr.
5,788,609 A 8/1998 Miller
5,788,610 A * 8/1998 Eschenbach ..... A63B 22/001 482/51
5,813,949 A 9/1998 Rodgers, Jr.
5,836,855 A * 11/1998 Eschenbach ..... A63B 22/001 482/57
5,893,820 A 4/1999 Maresh et al.
5,895,339 A 4/1999 Maresh
5,910,072 A 6/1999 Rawls et al.
5,916,065 A 6/1999 McBride et al.
5,924,962 A 7/1999 Rodgers, Jr.
5,938,567 A 8/1999 Rodgers, Jr.
5,997,445 A 12/1999 Maresh et al.
6,004,244 A 12/1999 Simonson
6,024,676 A * 2/2000 Eschenbach ..... A63B 22/001 482/51
6,126,573 A 10/2000 Eschenbach
6,135,926 A 10/2000 Lee
6,142,915 A * 11/2000 Eschenbach ..... A63B 22/001 482/52
6,146,313 A 11/2000 Whan-Tong et al.
6,168,552 B1 1/2001 Eschenbach
6,341,476 B2 1/2002 Golightly
6,422,977 B1 7/2002 Eschenbach
6,440,042 B2 8/2002 Eschenbach
6,672,992 B1 * 1/2004 Lo ..... A63B 22/0015 482/52
6,719,666 B1 * 4/2004 Lo ..... A63B 22/0015 482/52
6,802,797 B2 * 10/2004 Maresh ..... A63B 22/0007 482/52
6,994,657 B1 * 2/2006 Eschenbach ..... A63B 22/001 482/51
7,060,004 B2 6/2006 Kuo
7,153,239 B1 12/2006 Sterns
7,169,087 B2 1/2007 Ercanbrack et al.
7,175,568 B2 * 2/2007 Eschenbach ..... A63B 22/001 482/52
7,223,209 B2 5/2007 Lee
7,267,638 B2 9/2007 Wang
7,270,626 B2 * 9/2007 Porth ..... A63B 22/001 482/52
7,278,955 B2 * 10/2007 Giannelli ..... A63B 22/0056 482/51
7,316,633 B2 1/2008 Liao et al.
7,462,134 B2 * 12/2008 Lull ..... A63B 22/0015 482/52
7,462,135 B2 12/2008 Lo
7,494,447 B2 * 2/2009 Eschenbach ..... A63B 21/154 482/52
7,507,185 B2 * 3/2009 Eschenbach ..... A63B 22/001 482/52
7,520,839 B2 * 4/2009 Rodgers, Jr. ..... A63B 22/001 482/51
7,582,043 B2 9/2009 Liao et al.
7,654,936 B2 2/2010 Liao et al.
7,722,505 B2 5/2010 Liao et al.
7,758,473 B2 * 7/2010 Lull ..... A63B 22/0664 482/52
7,785,235 B2 * 8/2010 Lull ..... A63B 22/0017 482/52
7,841,968 B1 * 11/2010 Eschenbach ..... A63B 21/225 482/52
7,846,071 B2 12/2010 Fenster et al.
7,976,435 B2 * 7/2011 Van Handel ..... A63B 22/001 482/52
8,029,416 B2 * 10/2011 Eschenbach ..... A63B 22/0017 482/52
8,092,349 B2 1/2012 Liao et al.
8,376,913 B2 * 2/2013 Lee ..... A63B 22/0664 482/52
8,734,298 B2 * 5/2014 Murray ..... 482/52
8,894,549 B2 * 11/2014 Colledge ..... A63B 22/0046 482/52
9,339,684 B2 5/2016 Liao et al.
9,457,224 B2 * 10/2016 Giannelli ..... A63B 21/4034
10,011,338 B2 * 7/2018 Teal ..... A63B 22/0664
10,369,403 B2 8/2019 Liao et al.
2003/0236152 A1 * 12/2003 Lo ..... A63B 22/0023 482/52
2004/0043871 A1 3/2004 Chang
2005/0003932 A1 1/2005 Chen et al.
2005/0277519 A1 * 12/2005 Moon ..... A63B 22/0015 482/52
2006/0035757 A1 2/2006 Flick et al.
2007/0099763 A1 5/2007 Wang
2007/0232457 A1 * 10/2007 Porth ..... A63B 22/0664 482/51
2007/0235974 A1 * 10/2007 Vargas ..... B62M 1/26 280/256
2007/0238580 A1 * 10/2007 Wang ..... A63B 22/001 482/52
2009/0062081 A1 3/2009 Liao et al.
2010/0179034 A1 * 7/2010 Wang ..... A63B 22/14 482/110
2013/0035212 A1 * 2/2013 Chuang ..... A63B 22/001 482/52
2013/0143720 A1 * 6/2013 Chuang ..... A63B 22/001 482/52
2013/0196826 A1 * 8/2013 Colledge ..... A63B 22/0664 482/52
2016/0129301 A1 * 5/2016 Giannelli ..... A63B 21/4034 482/51

(56) References Cited

U.S. PATENT DOCUMENTS

FOREIGN PATENT DOCUMENTS

| | | |
|---|---|---|
| TW | M273359 | 8/2005 |
| WO | 07/55937 | 5/2007 |
| WO | 07/96701 | 8/2007 |

OTHER PUBLICATIONS

PCT/US06/042129, IPRP & Written Opinion dated May 6, 2008, ISR & Written Opinion dated Apr. 10, 2007, 13 pages.
Ex Parte Reexamination Certificate, U.S. Pat. No. 7722505 C1, dated Jul. 7, 2015, 3 pages.
U.S. Appl. No. 90/013,304; Office Action in Ex Parte Reexamination of U.S. Pat. No. 8,092,349 dated Jun. 3, 2015, 33 pages.
U.S. Appl. No. 90/013,304; Office Action in Ex Parte Reexamination of U.S. Pat. No. 8,092,349 dated Dec. 31, 2014, 21 pages.
U.S. Appl. No. 90/013,304; Response to Office Action in Ex Parte Reexamination of U.S. Pat. No. 8,092,349 Filed on Feb. 27, 2015, 31 pages.
Office Action in Ex Parte Reexamination in corresponding U.S. Pat. No. 7,722,505 dated Jan. 23, 2015.
Response to Ex Parte Reexamination in corresponding U.S. Pat. No. 7,722,505 filed on Mar. 20, 2015.
Decision Granting Ex Parte Reexamination of U.S. Pat. No. 7,722,505 mailed Oct. 9, 2014.
Request for Ex Parte Reexamination of U.S. Pat. No. 7,722,505 filed Jul. 25, 2014.
Request for Ex Parte Reexamination of U.S. Pat. No. 8,092,349 filed Jul. 25, 2014.
Petition for Inter Partes Review of U.S. Pat. No. 8,403,815 filed May 14, 2014.
Petition for Inter Partes Review of 7,654,936 filed May 14, 2014.

* cited by examiner

STATIONARY EXERCISE APPARATUS

CROSS-REFERENCE TO RELATED APPLICATIONS

This application is a continuation of U.S. patent application Ser. No. 15/095,901, filed Apr. 11, 2016, which is a continuation of U.S. patent application Ser. No. 13/782,798, filed on Mar. 1, 2013, issued as U.S. Pat. No. 9,339,684 on May 17, 2016, which is a continuation of U.S. patent application Ser. No. 13/335,437, filed on Dec. 22, 2011, issued as U.S. Pat. No. 8,403,815 on Mar. 26, 2013, which is a continuation of U.S. patent application Ser. No. 12/773,849, filed on May 5, 2010, issued as U.S. Pat. No. 8,092,349 on Jan. 10, 2012, which is a continuation of U.S. patent application Ser. No. 11/497,783, filed on Aug. 2, 2006, which issued as U.S. Pat. No. 7,722,505 on May 25, 2010, which claims the benefit of Chinese patent application no.: 200610103811.X, filed on Jul. 27, 2006, and is a continuation-in-part of U.S. patent application Ser. No. 11/434,541, filed on May 15, 2006, which issued as U.S. Pat. No. 7,682,290 on Mar. 23, 2010, which claims the benefit of Chinese patent application no.: 200510115518.0, filed Nov. 4, 2005, each of which is incorporated by reference in their entireties.

BACKGROUND OF THE INVENTION

This invention relates to stationary exercise apparatus, and more particularly to stationary exercise apparatus with adjustable components to vary the footpath and enhance exercise intensity of a user.

Stationary exercise apparatus have been popular for several decades. Early exercise apparatus typically had a single mode of operation, and exercise intensity was varied by increasing apparatus speed. More recently, enhancing exercise intensity in some apparatus has been made by adjusting the moving path of user's feet, such as by adjusting the incline or stride length of user's foot path.

U.S. Pat. No. 5,685,804 discloses two mechanisms for adjusting the incline of a stationary exercise apparatus, one of them having a linear track which can be adjusted and the other having a length adjusting swing arm. The swing arm lower end can be moved upwardly for a high incline foot path. U.S. Pat. No. 6,168,552 also discloses a stationary exercise apparatus having a linear track for changing the incline of the stationary exercise apparatus. U.S. Pat. No. 6,440,042 discloses a stationary exercise apparatus having a curved track for adjusting the incline of the stationary exercise apparatus.

Nonetheless, there is still a need for an exercise apparatus that can increase varieties of exercise and enhance exercise intensity of a user.

SUMMARY OF THE INVENTION

A stationary exercise apparatus in accordance with present invention includes a frame having a base, first and second supporting members coupled to the frame to rotate about an axis, a guider assembly coupled to the base, and first and second pedals coupled to the first and second supporting members. While operating the stationary exercise apparatus, the first and second pedals move along a closed path that can have a variety of shapes to vary the exercise experience and intensity. The present invention provides: a user of the stationary exercise apparatus with a benefit of high exercise intensity; an inclined foot path; a variable stride length; better gluteus exercise; and a more compact and succinct appearance.

DESCRIPTION OF THE PREFERRED EMBODIMENTS

Figure 1:
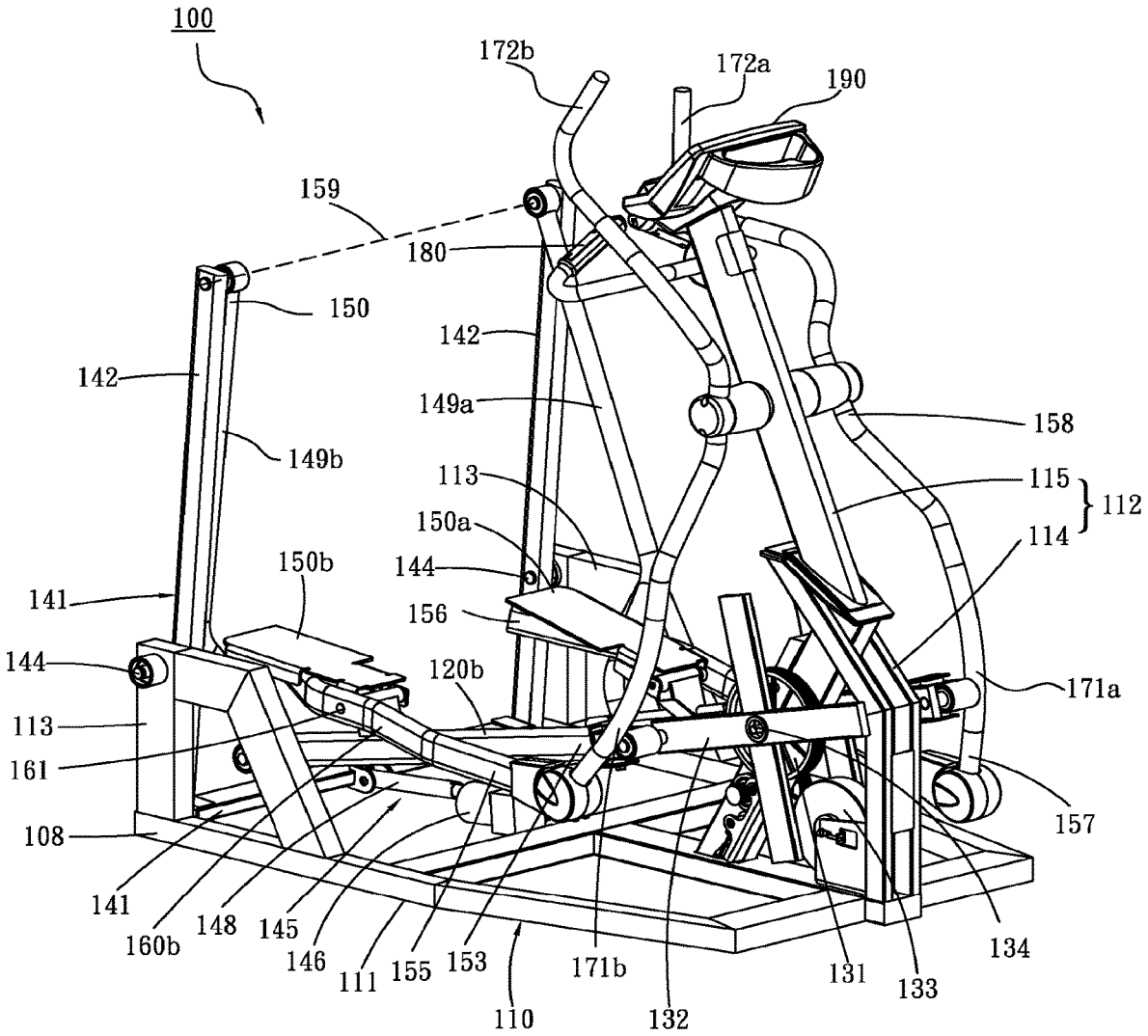
FIG. 1 is a perspective view of a stationary exercise apparatus according to a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Now referring to FIG. 1, a stationary exercise apparatus 100 is illustrated therein. The stationary exercise apparatus 100 has a frame 110 generally comprising a base 111, a front portion 112, a rear portion 108, and side portions 113. The base 111 is substantially a horizontal frame adapted to stably rest on a ground, floor or other similar supporting surface. The front portion 112 is fixed on the base 111, and preferably includes a post 114 and a standard 115. The side portions 113 are respectively mounted on the left and right sides of the base portion 111. A fixed handle assembly 180 and a console 190 are mounted on or near the upper end of the standard 115. Left and right cranks 132 (FIG. 2) are each pivoted to one portion of the frame 110 defining a first axis 134 and in the illustrated embodiment, the first axis 134 is at or near the front portion of the frame 110. The left and right cranks 132 could be replaced by a pair of disks, flywheels, or other device rotating about the first axis 134. The left and right cranks 132 and the first axis 134 can also be replaced by a pair of closed tracks circulating about a virtual axis, as opposed to an axis defined by a wheel axle. The frame 110 may further comprise a pulley 133 and a resistance member 135 which is controlled by using the console 190 to vary operating resistance for a user.

Figure 2:
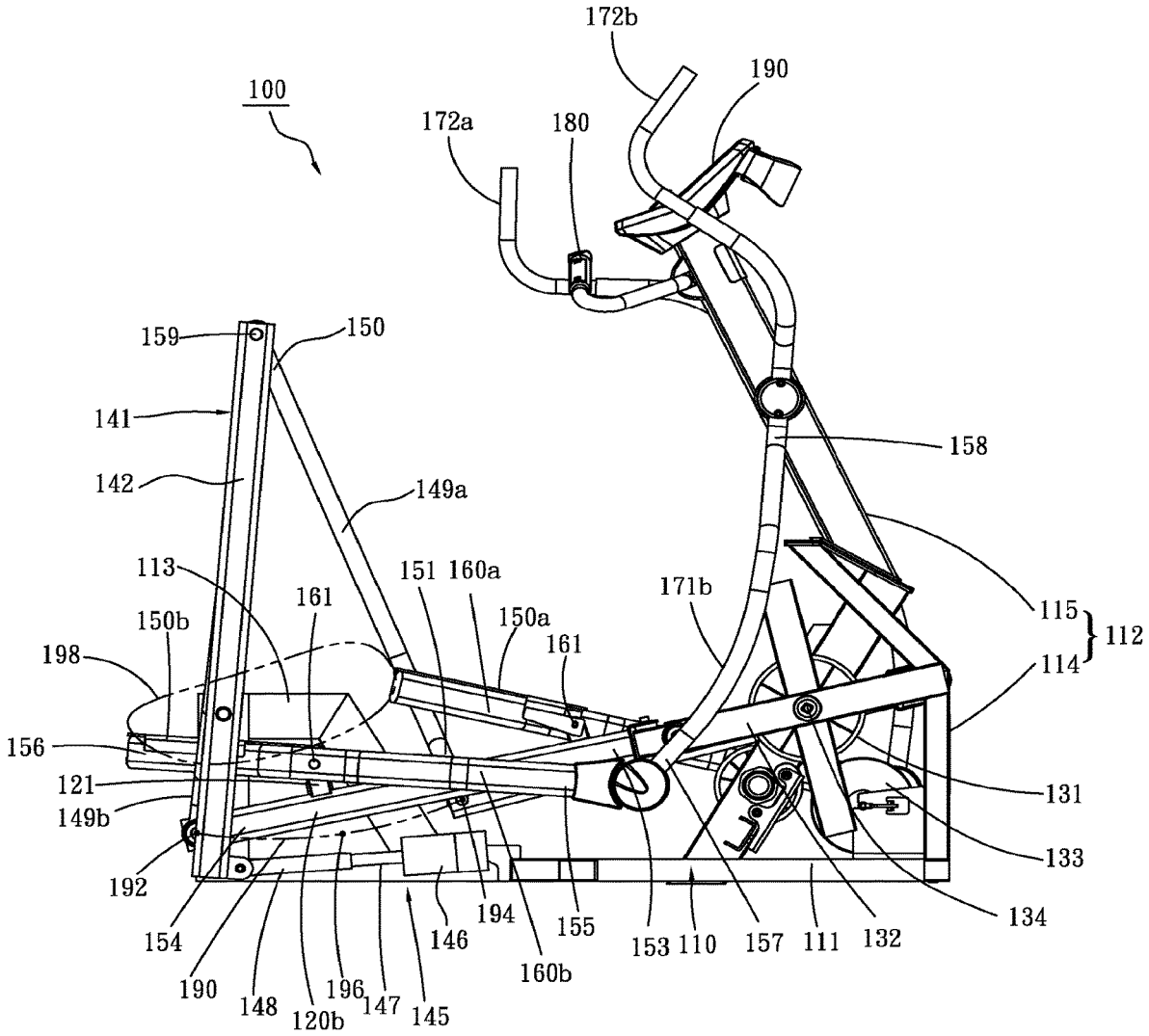
FIG. 2 is a side view of the stationary exercise apparatus of FIG. 1 in a rotating position of a low incline condition.
Figure 3:
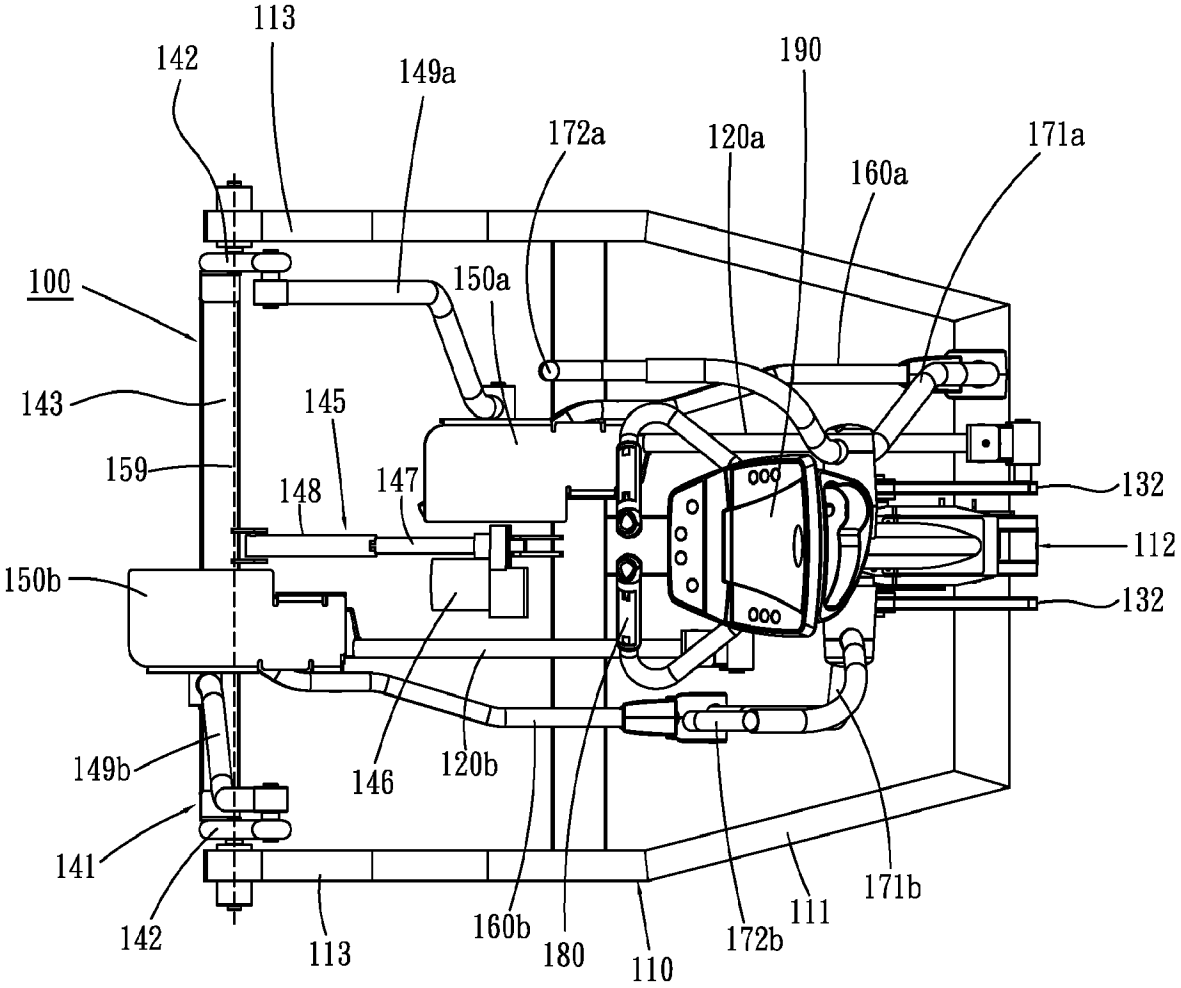
FIG. 3 is a top view of the stationary exercise apparatus of FIG. 1.
Figure 6:
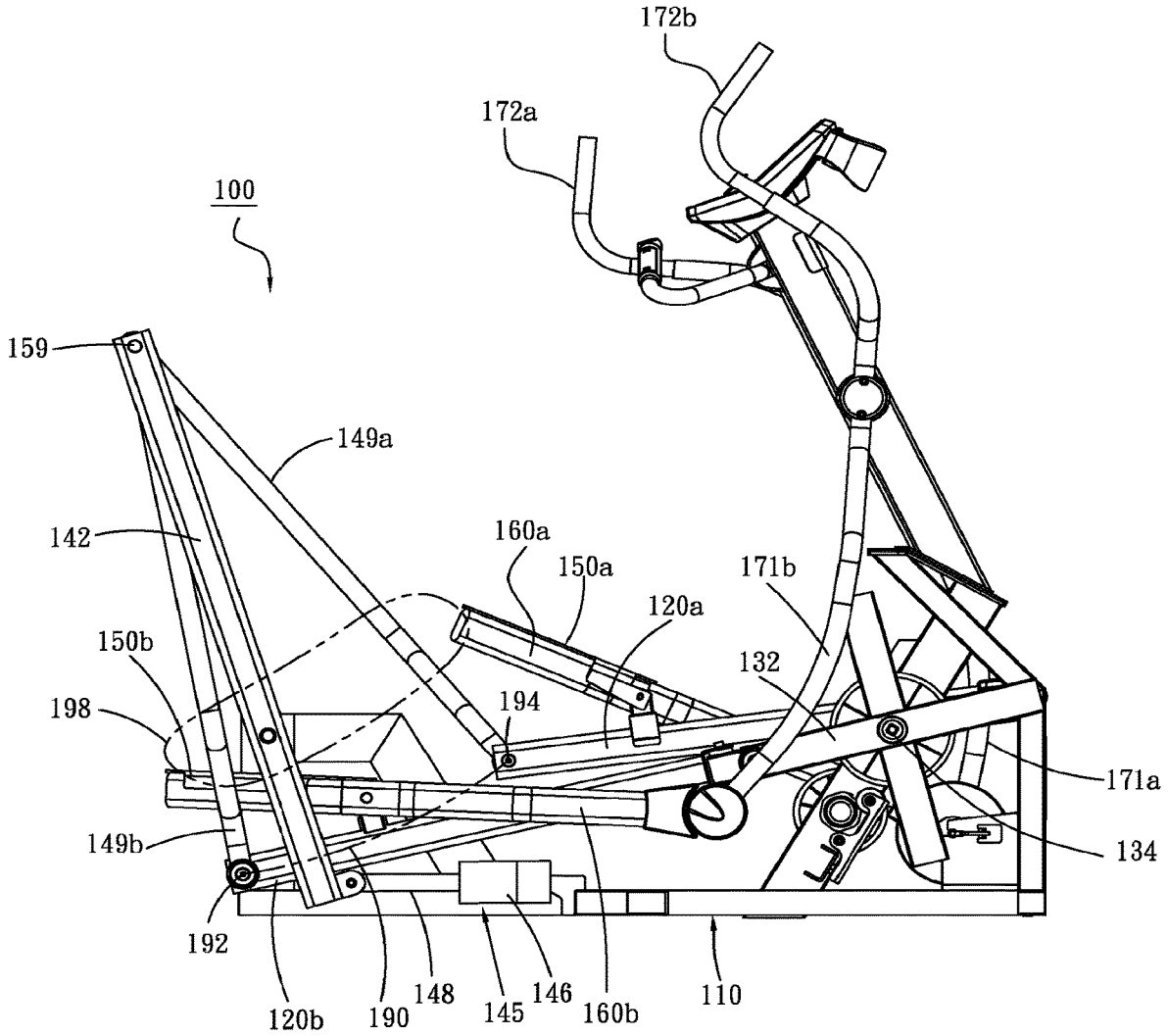
FIG. 6 is a side view of the stationary exercise apparatus of FIG. 1 in a rotating position of a high incline condition.

Now referring to FIGS. 1 and 2, the frame 110 further comprises a moving assembly 141 mounted on the side portions 113 respectively. In a preferred embodiment of the present invention as shown in FIG. 1, the moving assembly 141 has first and second moving members 142, in a generally upright position, and a lateral link 143 (FIG. 4) connecting the first and second moving members 142 to one another. The first and second moving members 142 are joined to the side portions 113 via a second axis 144 so that the upper end portions of the first and second moving members 142 can be adjusted by pivoting the first and second moving members 142 about the second axis 144. There is an optional adjusting assembly 145 mounted between the moving assembly 141 and the frame 110 for adjusting the moving assembly 141 about the second axis 144. The preferred embodiment of the adjusting assembly 145 generally includes a motor 146, a screw rod 147, and a screw tube 148. The motor 146 has one end connected to the base portion 111 and the other end connected to one end of the screw rod 147. The other end of the screw rod 117 is connected to one end of the screw tube 148. The other end of the screw tube 148 is connected to the moving assembly 141 so that the effective length of the screw rod 147 and the screw tube 148 combination is adjustable to move the lower end of the first and second moving members 142 fore and aft. As the lower ends move, the upper ends of the first and second moving members 142 are pivoted in the opposite direction about the second axis 144. The upper end portions of the first and second moving members 142 are adjustable anywhere between a first position as shown in FIG. 2 and a second position as shown in FIG. 6. Although described and illustrated as a screw adjusting mechanism, the adjusting assembly 145 could be any manual or automatic mechanical, electromechanical, hydraulic, or pneumatic device and be within the scope of the invention. The adjusting assembly 145 is illustrated as being mounted on the right side of the exercise device 100, but both moving members 142 are adjusted because a lateral link 143 (FIG. 4) transfers the force to the left side moving member 143.

Figure 4:
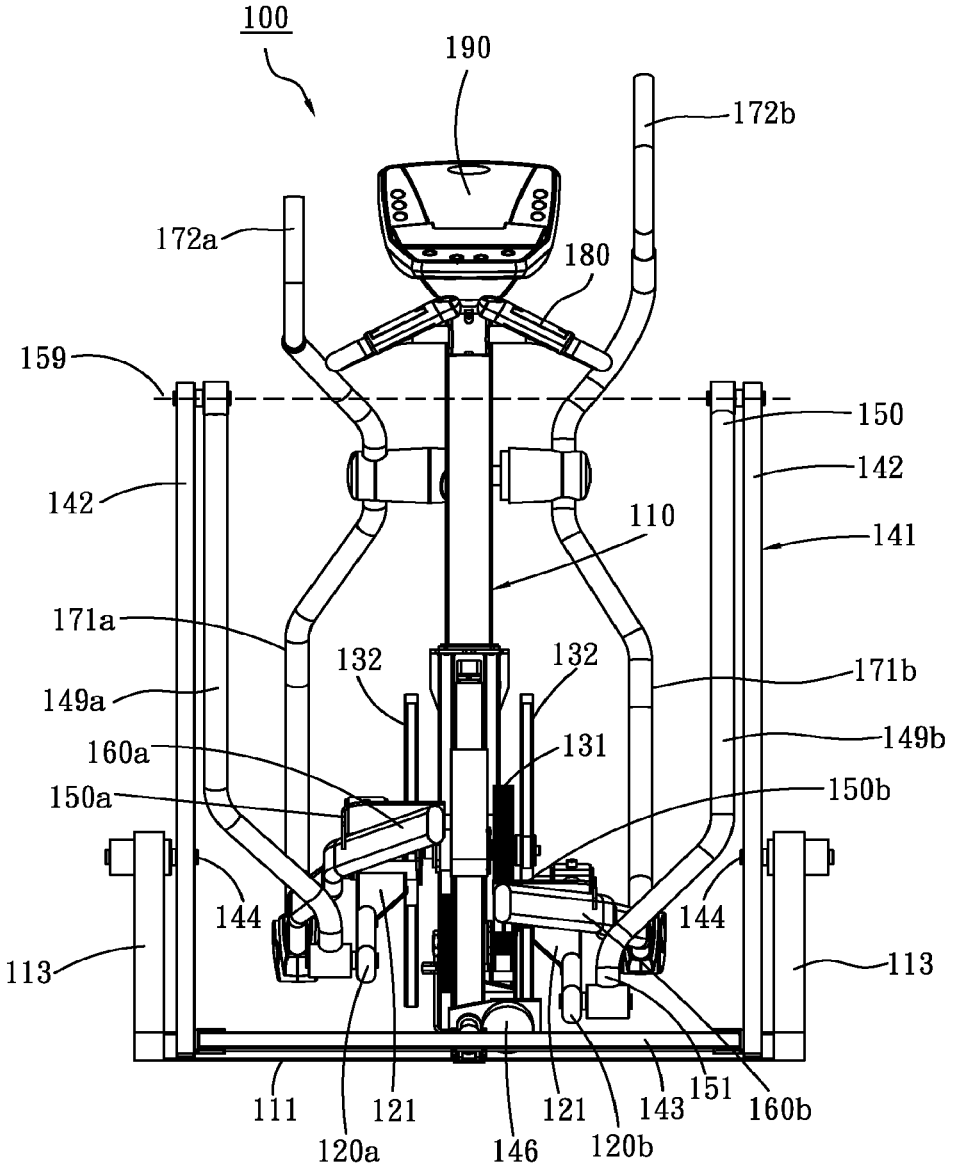
FIG. 4 is a back view of the stationary exercise apparatus of FIG. 1.

Referring to FIGS. 2 and 4, the stationary exercise apparatus 100 comprises first and second swing members 149*a*/149*b*, each of the swing members 149*a*/149*b* having an upper portion 150 and a lower portion 151. The upper portions 150 of the first and second swing members 149*a*/149*b* can be coupled to the frame 110 via a swing axis 159 for swinging motion relative to the frame. In the preferred embodiment of the present invention, the upper portions 150 of the first and second swing members 149*a*/149*b* are respectively pivoted to the first and second moving members 142 via the swing axis 159 so that the swing axis 159 can be adjusted forward or backward anywhere between the first position shown in FIG. 2 and the second position shown in FIG. 6. Different positions of the swing axis 159 cause different exercise intensity of the stationary exercise apparatus 100.

Figure 5:
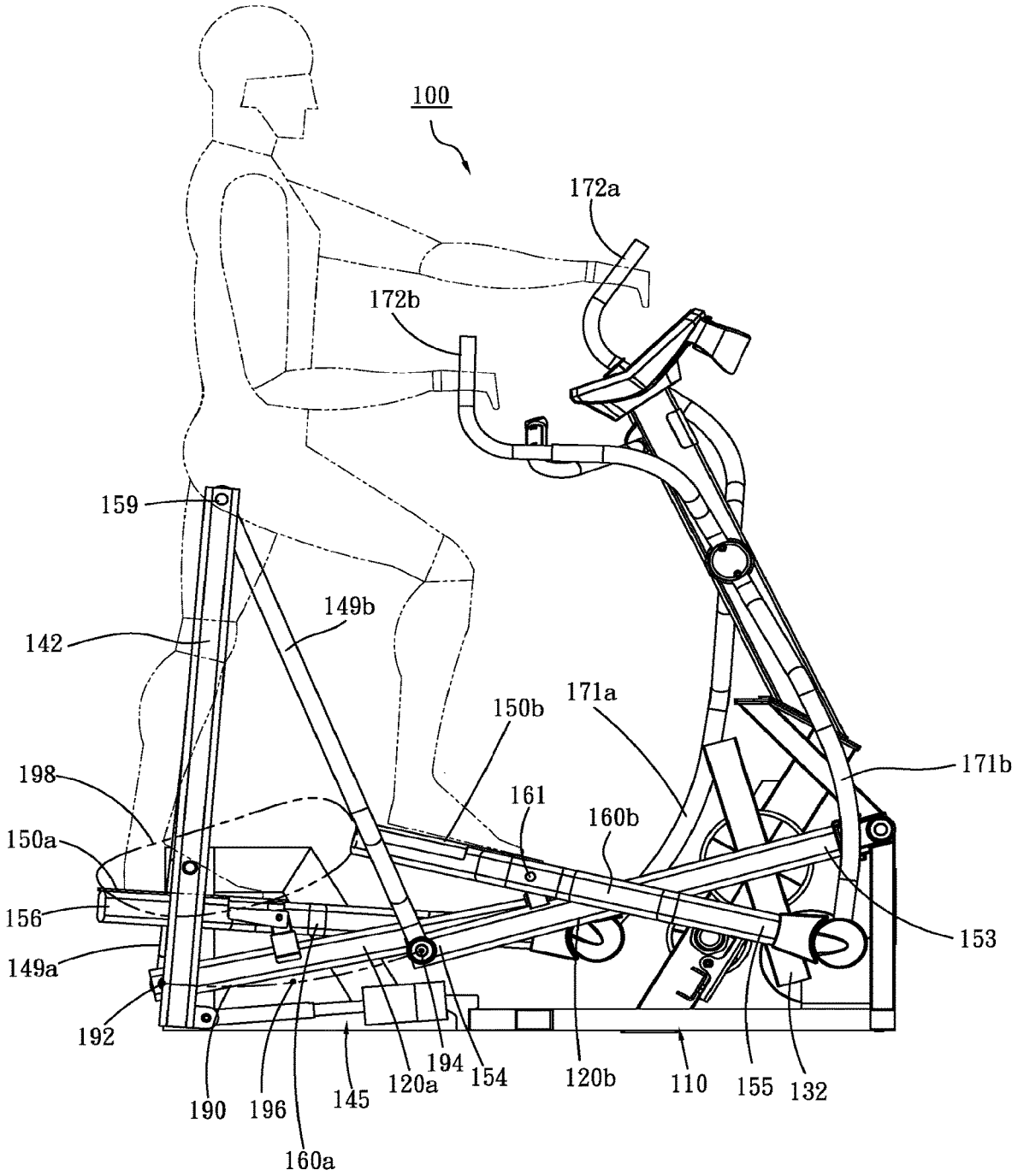
FIG. 5 is a side view of the stationary exercise apparatus of FIG. 1 in another rotating position of the low incline condition.

Now referring to FIGS. 2, 4 and 5, the stationary exercise apparatus 100 comprises first and second supporting members 120*a*/120*b*, each of the first and second supporting members 120*a*/120*b* having a first end portion 153 and a second end portion 154. The first end portions 153 of the first and second supporting members 120*a*/120*b* are respectively coupled to the frame 110 to rotate about the first axis 134. In the preferred embodiment of the present invention, the first end portions 153 of the first and second supporting members 120*a*/120*b* are respectively pivoted to the left and right cranks 132 to rotate about the first axis 134. As mentioned previously, the left and right cranks 132 may be replaced by flywheels or disks and the like. The second end portions 154 of the first and second supporting members 120*a*/120*b* are respectively pivoted to the lower portions of the first and second swing members 149*a*/149*b* so that the second end portions 154 of the first and second supporting members 120*a*/120*b* may be moved along a reciprocating path 190 (as shown in FIGS. 2 and 5) while the first end portions 153 of the first and second supporting members 120*a*/120*b* are being rotated about the first axis 134.

Referring to FIGS. 1 through 6, the stationary exercise apparatus 100 further comprises first and second control links 160*a*/160*b* respectively pivotally connected to the first and second supporting members 120*a*/120*b*. Each of the first and second control links 160*a*/160*b* has a first end portion 155 and a second end portion 156. The first end portions 155 of the first and second control links 160*a*/160*b* are movably coupled to the frame 110. In the preferred embodiment of the present invention, the first end portions 155 of the first and second control links 160*a*/160*b* are respectively connected to first and second handle links 171*a*/171*b*. More specifically, each of the first and second handle links 171*a*/171*b* has lower and upper end portions. The lower end portions 157 of the first and second handle links 171*a*/171*b* are respectively pivoted to the first end portions 155 of the first and second control links 160*a*/160*b* and the upper end portions 158 of the first and second handle links 171*a*/171*b* are pivoted to the frame 110 so that, the first and second handle links 171*a*/171*b* can guide the first end portions 155 of the first and second control links 160*a*/160*b* in a reciprocating path. There are several alternatives of performing the same function of the first and second handle links 171*a*/171*b*. For example, the frame 110 can include a pair of tracks allowing the first end portions 155 of the first and second control links 160*a*/160*b* movably coupled to the tracks via rollers or sliders. For simplicity, all such alternatives are referred to herein as "handle links" even when they do not serve as handles for the user.

Still referring to FIGS. 1 through 6, the stationary exercise apparatus 100 includes first and second pedals 150*a*/150*b* respectively coupled to the first and second supporting members 120*a*/120*b*. In the preferred embodiment of the present invention, the first and second pedals 150*a*/150*b* are indirectly connected to the first and second supporting members 120*a*/120*b*. More specifically, the first and second pedals 150*a*/150*b* are respectively attached to the second end portions 156 of the first and second control links 160*a*/160*b* which are pivotally connected to the first and second supporting members 120*a*/120*b*. Therefore, rear end portions 158 of the first and second pedals 150*a*/150*b* are directed by the first and second supporting members 120*a*/120*b* to move along a second closed path 198 (FIGS. 2, 5, and 6) while the first end portions 153 of the first and second supporting members 120*a*/120*b* rotating about the first axis 134. The first and second pedals 150*a*/150*b* can also be directly attached to the first and second supporting members 120*a*/120*b*, similar to the teaching of U.S. Pat. No. 5,685,804. It should be noticed that both indirect and direct connections between the first and second pedals 150*a*/150*b* and the first and second supporting members 120*a*/120*b* can cause the rear end portions of the first and second pedals 150*a*/150*b* to move along similar closed paths, and are within the scope of the present invention.

Now referring to FIGS. 2 and 5, the reciprocating path 190 of the first and second swing members 149*a*/149*b* has a rear end 192, a front end 194, and a middle point 196. The middle point 196 is substantially the middle point between the rear end 192 and the front end 194. As shown in FIG. 2, the second end portion of the second support member 120*b* is being at the rear end 192 of the reciprocating path 190 while the first end of the second supporting member 120*b* is being approximately at the rearmost position during rotating about the first axis 134. As also shown in FIG. 5, the second end of the second support member 120*b* is being at the front end 194 of the reciprocating path 190 while the first end of the second supporting member 120*b* is being approximately at the foremost position during rotating about the rotating axis 134. In the preferred embodiment of the present invention, the reciprocating path 190 is substantially arcuate because of the swing motion of the first and second swing members 149*a*/149*b*, but the present invention is not limited to an arcuate reciprocating path. It should be noticed that relative positions between the swing axis 159 and the reciprocating path 190 can cause different exercise intensity of the stationary exercise apparatus 100.

More specifically, the positions of the swing axis 159 can determine incline levels of both the reciprocating path 190 and the second closed path 198. If the swing axis 159 is substantially vertically above the middle point 196 of the reciprocating path 190, the incline level of both the reciprocating path 190 and the second closed path 198 are substantially horizontal. If the swing axis 159 is positioned rearwardly in view of an orientation of an operating user, the incline levels of both the reciprocating path 190 and the second closed path 198 are increased. A higher incline level of the second closed path 198 creates higher exercise intensity of a user. As shown in FIG. 2, the swing axis 159 is positioned slightly in back of the middle point 196 of the reciprocating path 190 so that the second closed path 198 is slightly inclined and the exercise intensity is enhanced. In order to obtain higher exercise intensity, the swing axis 159 can be re-positioned farther toward the rear. As shown in FIG. 6, the swing axis 159 is in back of the rear end 192 of the reciprocating path 190 and both the reciprocating path 190 and the second closed path 198 are in a relatively high incline level so that the exercise intensity of the stationary exercise apparatus 100 is further increased.

In a preferred embodiment of the present invention, the adjusting assembly 145 can be controlled via the console 199 to vary the incline level of the second closed path 198 and to adjust the exercise intensity of the stationary exercise apparatus 100. As mentioned previously, the upper portions 150 of the first and second swing members 149*a*/149*b* are coupled to the moving assembly 141 of the frame 110. The adjusting assembly 145 is connected between the lateral link 143 (FIG. 5) of the moving assembly 141 and the frame 110. Therefore, a user can electronically actuate the adjusting assembly 145 to vary the position of the swing axis 159 and adjust the incline level of the second closed path 198. It should be noted that the (lateral) link 143 could be omitted in some embodiments, not shown in the figures. For example, two adjusting assemblies 145 are directly connected to the first and second moving members 142 respectively. The benefit of omitting the (lateral) link 143 is that the height of the first and second pedal 150*a*/150*b* could be lower because of less interference between the (lateral) link 143 and the second end portions of the first and second supporting members 120*a*/120*b*. A user may feel more comfortable in a lower operating position. It should also be noticed that the incline level of the stationary exercise apparatus 100 is not limited to an electronically adjustment. Some manual adjustments, such as pin and holes combinations, levers, cranks and the like are also within the scope of the present invention.

FIG. 5 shows the swing axis 159 is positioned to the rear of the middle point 196 of the reciprocating path 190 and the second closed path 198 is in a low incline level. FIG. 6 shows the swing axis 159 is positioned to the rear of the rear end 192 of the reciprocating path 190 and the second closed path 198 is in a higher incline level. In other embodiments of the present invention, the incline level of the second closed path 198 could also be non-adjustable. For example, the side portions 113 of the frame 110 extend upwardly and the first and second swing members 149*a*/149*b* are directly pivoted to the side portions 113 of the frame 110. In the non-adjustable embodiments, when the swing axis 159 is positioned slightly in back of the middle point 196, the second closed path 198 is in the low incline level, not flat, such as shown in FIG. 5. When the swing axis 159 is positioned in back of the rear end 192 of the reciprocating path 190, the second closed path 198 would be in the high incline level as shown in FIG. 6. Both the low and high incline level of the stationary exercise apparatus 100 can enhance exercise intensity of a user, comparing to a more horizontal incline level.

To operate the stationary exercise apparatus 100, a user respectively steps on the first and second pedals 150*a*/150*b* and grabs on the fixed handle assembly 180 or a pair of moving handles 172*a*/172*b*. The first end portions 153 of the first and second supporting members 120*a*/120*b* rotate along a substantially arcuate path about the first axis 134 and the second ends of the first and second supporting members 120*a*/120*b* move along the reciprocating path 190. Therefore, rear end portions of the first and second pedals 150*a*/150*b* move along the second closed path 198. As mentioned previously, the positions of the swing axis 159 are relative to some geometry parameters of the second closed path 198 and have great effects on the exercise intensity of a user of the stationary exercise apparatus 100.

Figure 8:
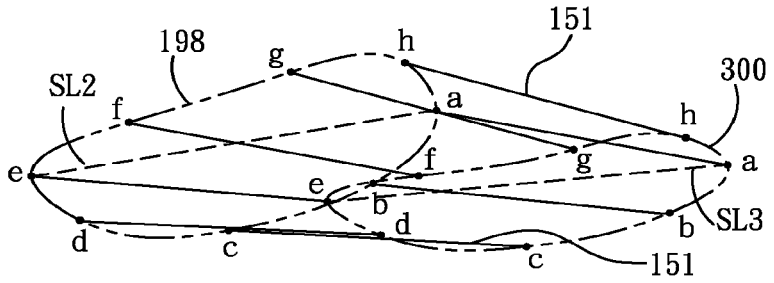
FIG. 8 are toe and heel path profiles of the stationary exercise apparatus of FIG. 1 in a relatively low incline condition.
Figure 9:
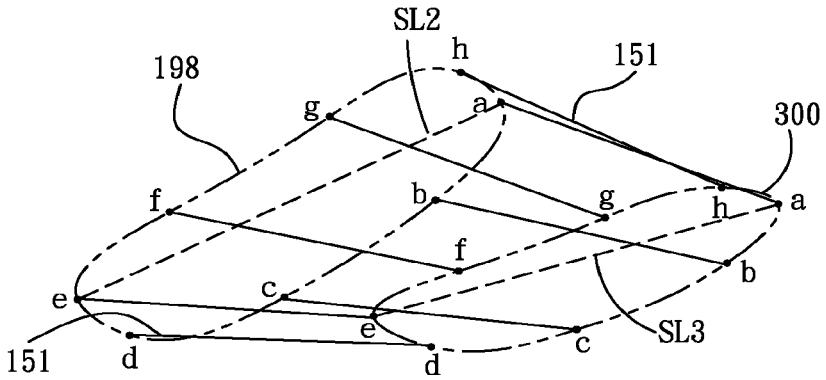
FIG. 9 are toe and heel path profiles of the stationary exercise apparatus of FIG. 1 in a relatively high incline condition.
Figure 10:
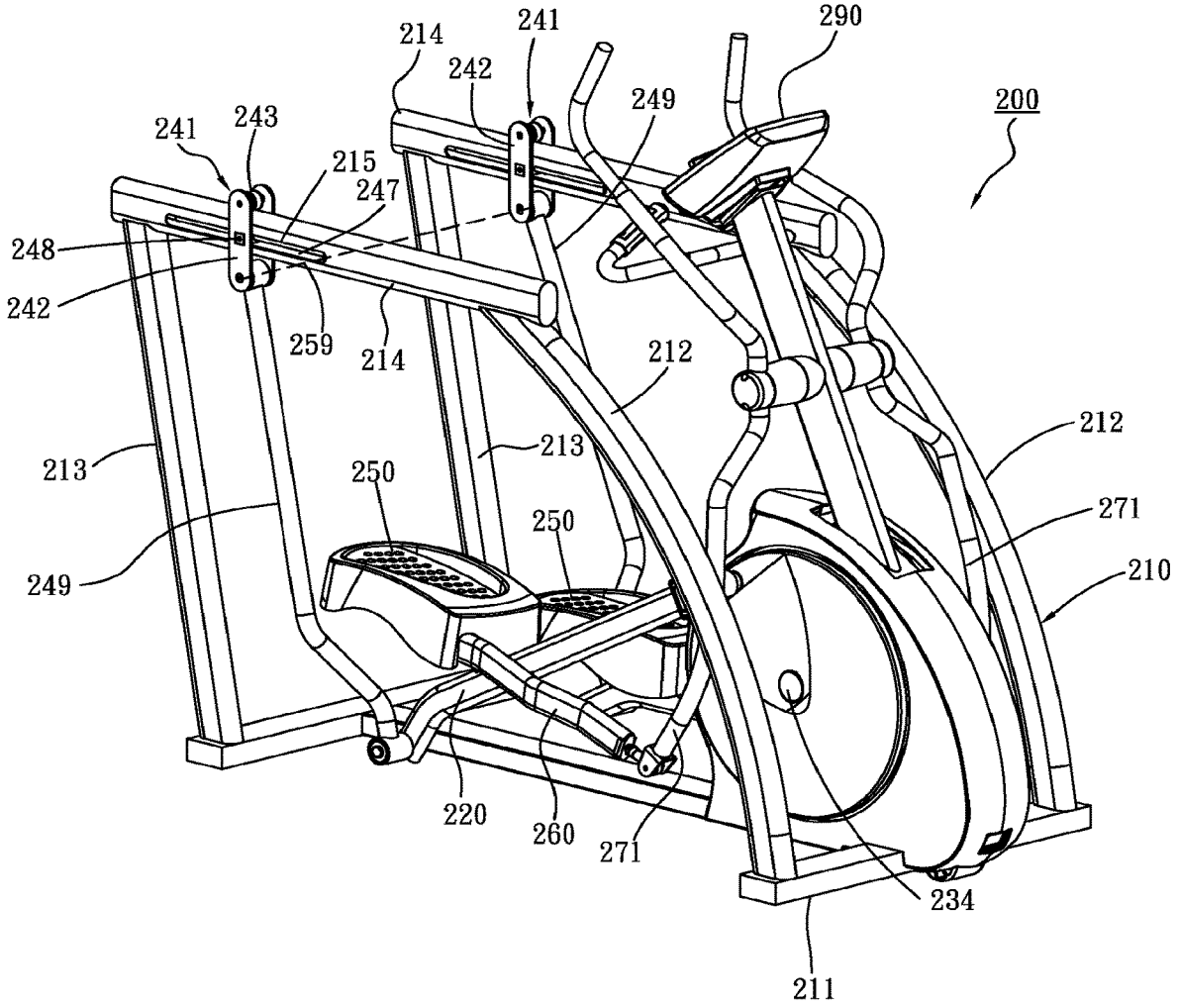
FIG. 10 is a perspective view of a stationary exercise apparatus according to another embodiment of the present invention.
Figure 11:
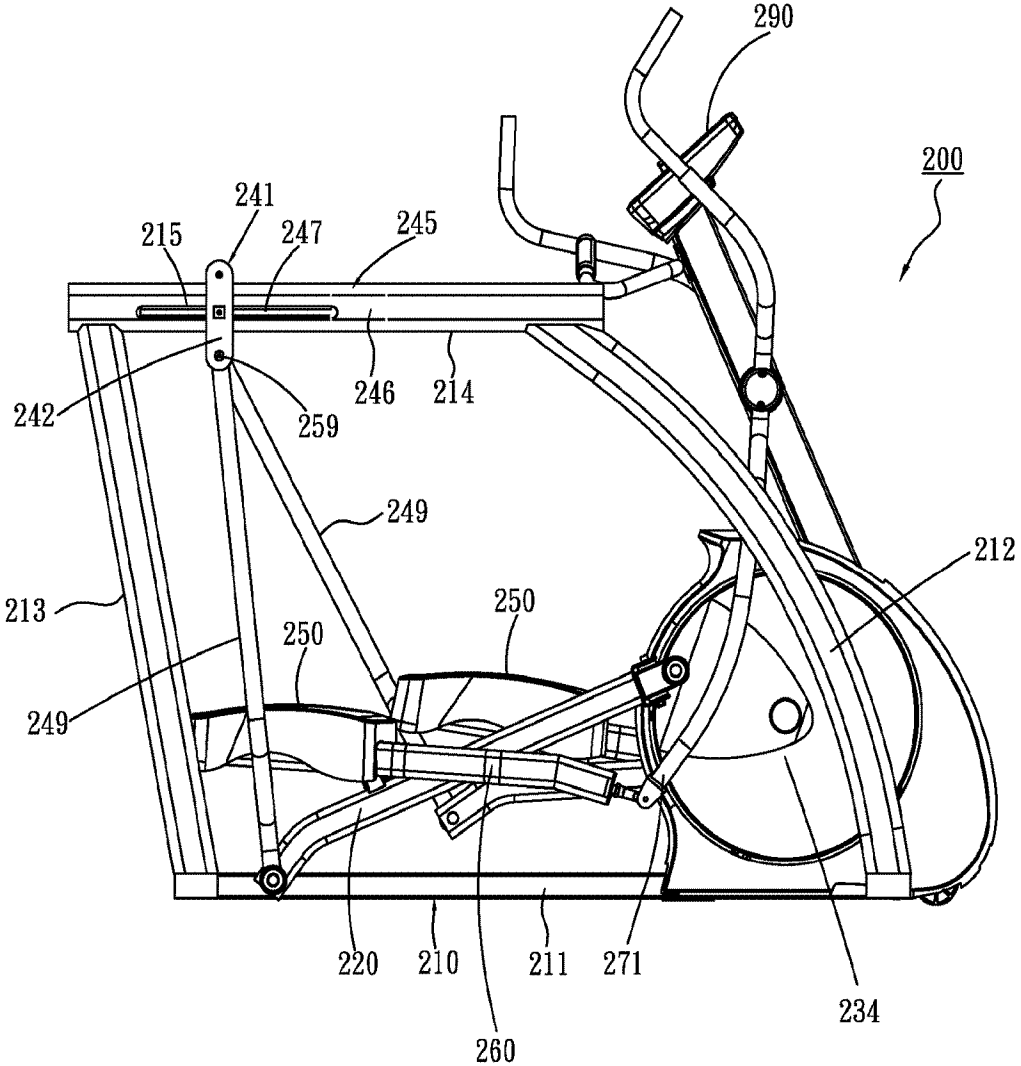
FIG. 11 is a side view of the stationary exercise apparatus of FIG. 10.
Figure 12:
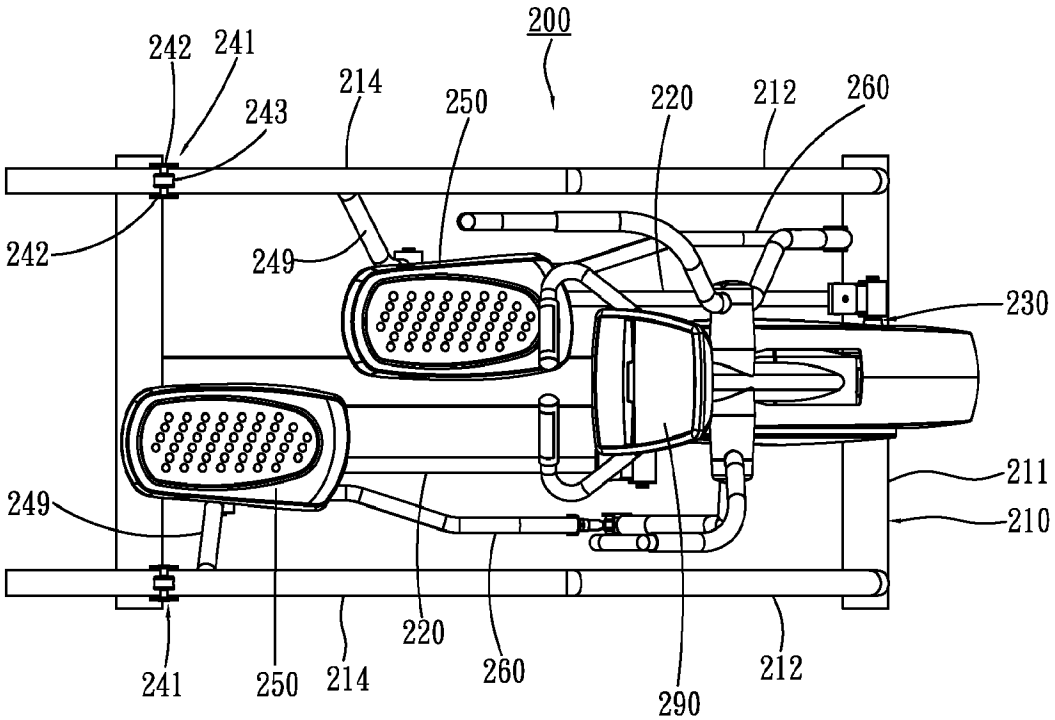
FIG. 12 is a top view of the stationary exercise apparatus of FIG. 10.

To better present the relationship between the swing axis 159 and the second closed path 198, separated path information is illustrated in FIGS. 8 and 9. FIG. 8 shows the path information and geometry parameters while the swing axis 159 is slightly in back of the middle point 196 as shown in FIG. 5. FIG. 9 shows the path information and geometry parameters while the swing axis 159 is to the rear of the rear end 192.

Now referring to FIG. 8 in more detail, the second closed path 198 is represented by eight correspondent points, a~h. The correspondent points a and e are the foremost and rearmost positions of the first ends of the first and second supporting members 120*a*/120*b* during rotating about the first axis 134. Each point is separated in an equal angle of forty-five degrees relative to the angle of rotation about the first axis 134. A stride length SL2 constituted by the correspondent points a and e is also one of the geometry parameters of the second closed path 198, in addition to the incline level. The stride length SL2 is substantially the stride length of the heel portion of a user because the second closed path 198 is the moving path of the rear ends of the pedals 150*a*/150*b* and the heel portion of a user is approximate to the rear ends of the pedals 150*a*/150*b*. Stride length is also relative to exercise intensity. A longer stride length generally results in higher exercise intensity. A third closed path 197 is the moving path of the front ends of the pedals 150*a*/150*b*. A stride length SL3 may also substantially represent the stride length of the toe portion of a user. Because the closed paths 198 and 197 are moving paths of the rear and front ends of the pedals 150*a*/150*b*, the orientation of the pedals 150*a*/150*b* can be illustrated by a pedal orientation 151 as shown in FIG. 8. One important character of the pedal orientation 151 is that the steepness of the pedal orientation 151 is increased when the swing axis 159 is adjusted backwardly.

Figure 7:
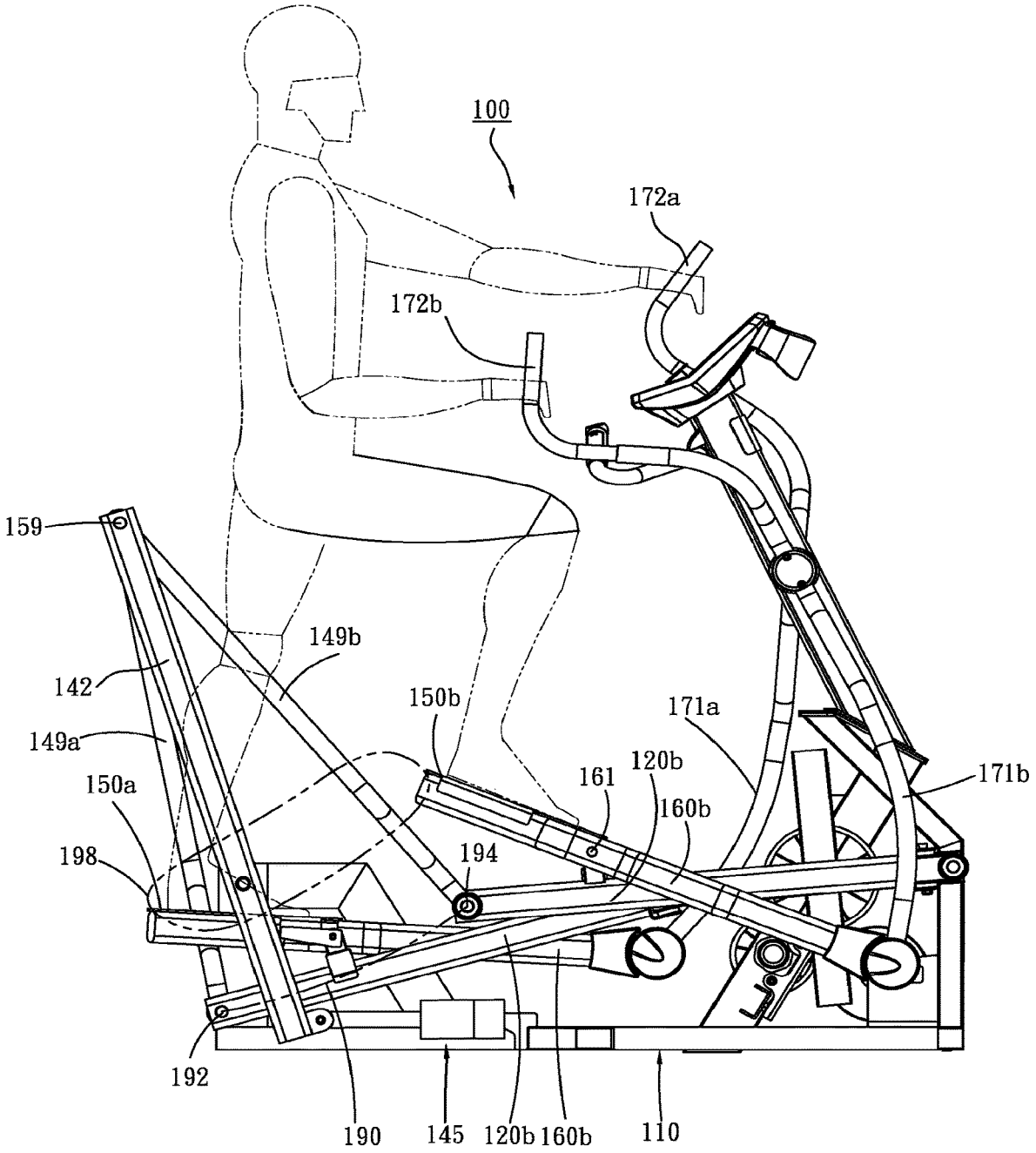
FIG. 7 is a side view of the stationary exercise apparatus of FIG. 1 in another rotating position of the high incline condition demonstrating better gluteus exercise of a user.

Now referring to FIGS. 7 and 9 show the stride length SL2, stride length SL3, pedal orientation 151, second closed path 198, and third closed path 197 while the swing axis 159 is in back of the rear end 192 of the arcuate path 190. As shown in FIG. 7, the first and second control links 160*a*/160*b* are respectively pivoted to the first and second supporting members 120*a*/120*b* via pivot axes 161. The incline level of the second closed path 198 of FIG. 9 is increased by 17 degrees compared to the incline level of FIG. 8, but the incline level of the third closed path 197 of FIG. 9 is only increased by 11 degrees. That is, the incline level of the second closed path 198 is increased more than the incline level of the third closed path 197 while the swing axis 159 is being adjusted backwardly. The stride length SL2 of FIG. 9 is increased by about 15 percent compared to the stride length SL2 as shown in FIG. 8, but the stride length SL3 of FIG. 9 is only increased by about 6 percent. That is, the stride length SL2 is increased more than the stride length SL3 while the swing axis 159 is being adjusted backwardly. Because both path inclination and stride length of the heel portion of a user are increased more than the toe portion, the exercise intensity of the heel portion is higher than the exercise intensity of the toe portion of a user which may also imply a higher exercise intensity of the gluteus of a user. Because the heel portion of the user is obviously elevated as shown in FIG. 7, the thigh of the user is elevated to a substantially horizontal orientation relative to the ground surface so that the gluteus of the user is fully exercised.

Now referring to FIGS. 10 through 13, a second preferred embodiment of the present invention is shown. A stationary exercise apparatus 200 comprises a frame 210 having a base portion 211 adapted to rest on a surface. The frame 210 further comprises a front portion 212 extending upwardly from the base portion 211, a side portion 214 extending longitudinally rearward from the front portion 212, and a rear portion 213 connecting the side portion 214 and the base portion 211.

The stationary exercise apparatus 200 further has first and second supporting members 220, each of the supporting members 220 having a first end portion and a second end portion. The first end portions of the first and second supporting members 220 are respectively pivoted to a pair of rotating members 233 in order to rotate about a first axis 234. The second end portions of the first and second supporting members 220 are respectively connected to the lower portions of first and second swing members 249. The upper portions of the first and second swing members 249 are coupled to the side portion 214 of the frame 210 via a swing axis 259. More specifically, the upper portions of the first and second swing members 249 are pivotally connected to left and right moving assemblies 241.

Each of the left and right moving assemblies 241 respectively comprises third and fourth moving members 242. Each of the third and fourth moving members 242 is connected to left and right adjusting assemblies 245 (FIG. 11) so that the moving assemblies 241 could be driven by the adjusting assemblies 245. Each of the left and right moving assemblies 241 further includes an optional roller 243. The rollers 243 are respectively engaged on the side portion 214 for increasing stability and smoothness of movement of the moving assemblies 241 along the side portion 214.

Figure 13:
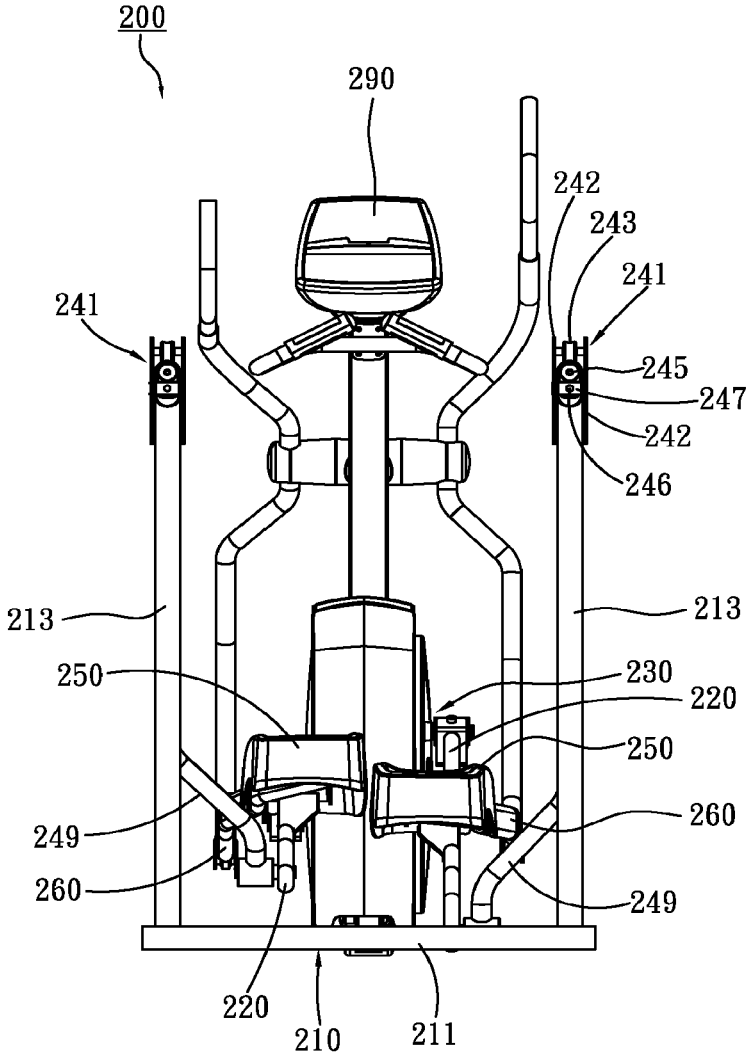
FIG. 13 is a back view of the stationary exercise apparatus of FIG. 10.

As illustrated in FIG. 13, each of the adjusting assemblies 245 includes a motor 246 mounted on one portion of the frame 210, a screw rod 247, and a screw member 248. The screw rod 247 has one end connected to the motor 246 and a portion adapted for movement of the screw member 248. Although described and illustrated as a screw adjusting mechanism, the adjusting assembly 245 could be any manual or automatic mechanical, electromechanical, hydraulic, or pneumatic device and be within the scope of the invention.

In the second preferred embodiment of the present invention, the upper portions of the first and second swing members 249 are respectively pivoted to the third and fourth moving members 242. But, the upper portions of the first and second swing members 249 can also be directly pivoted to the screw members 248 of the adjusting assemblies 245. Therefore, actuating of the motor 246 can cause rotation of the screw rod 247 to change the positions of both the third and fourth moving member 242 and the swing axis 259.

Similar to the previous preferred embodiment of the stationary exercise apparatus 100, the stationary exercise apparatus 200 also comprises a pair of pedals 250 respectively coupled to the supporting members 220. Optionally, the stationary exercise apparatus 200 also has a pair of control links 260 respectively pivoted to the supporting members 220 and a pair of handle links 271 coupled to the frame 210 for guiding the control links 260.

Figure 14:
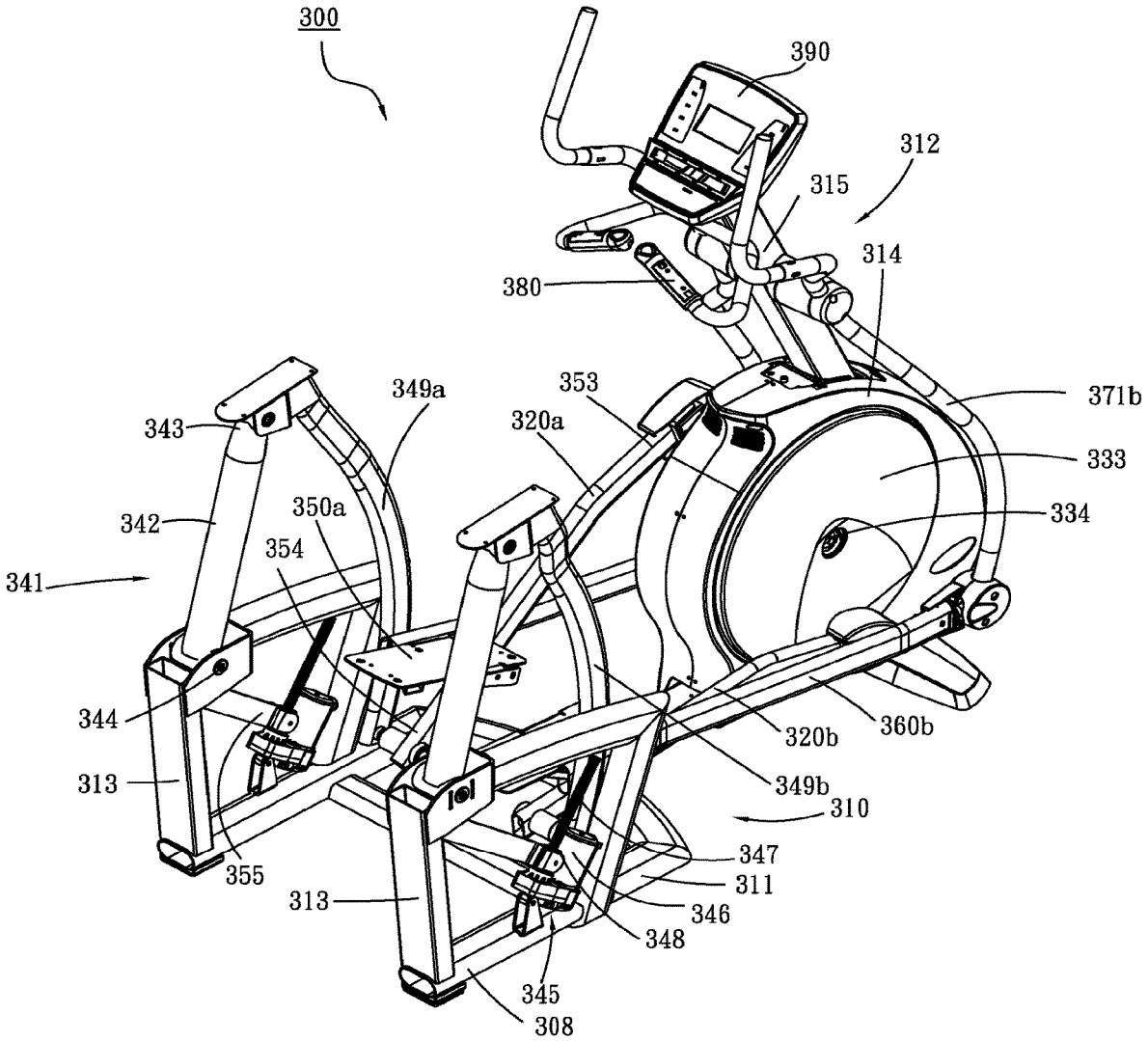
FIG. 14 is a perspective view of a third embodiment of a stationary exercise device in accordance with the present invention.
Figure 15:
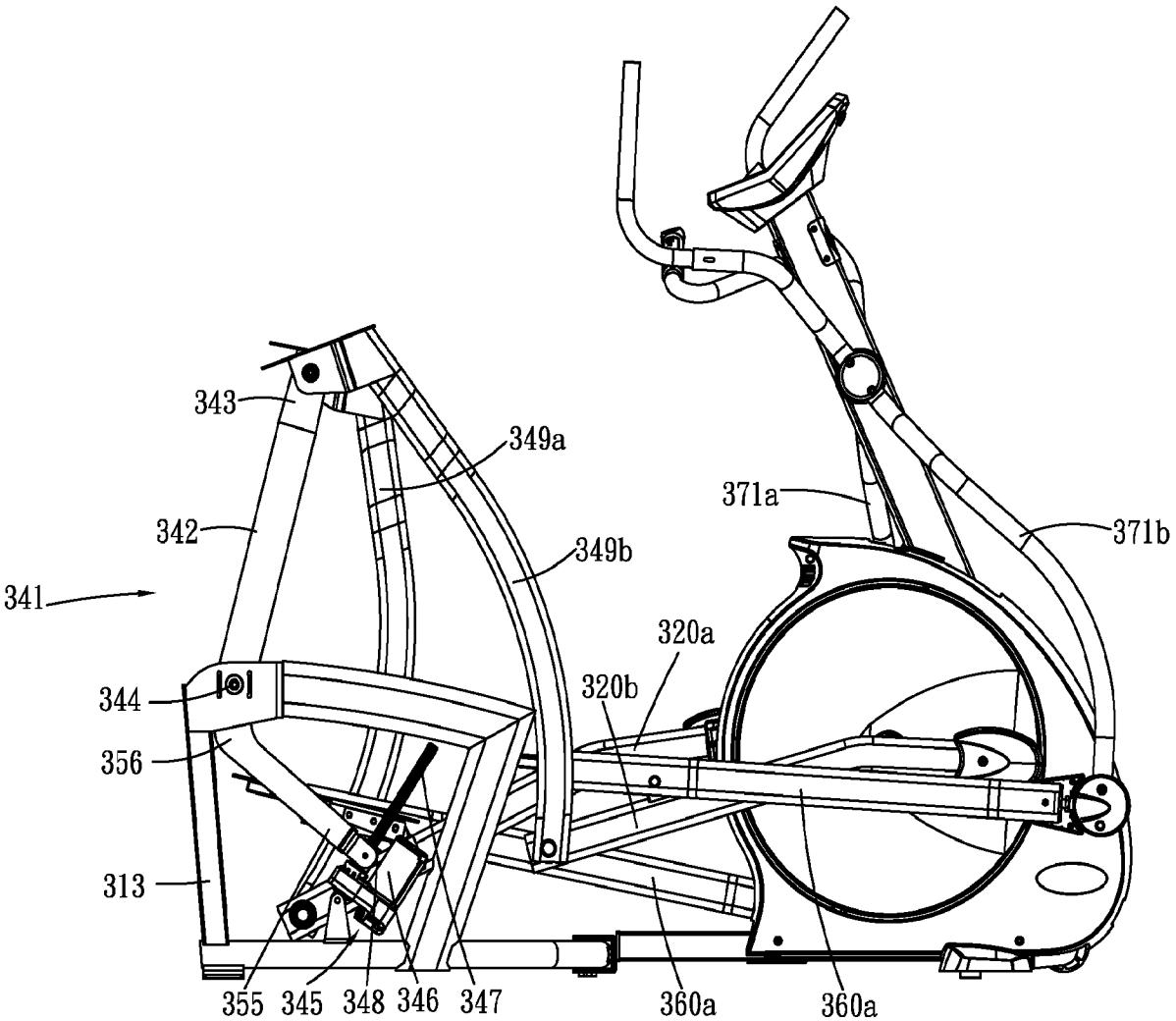
FIG. 15 is a side view of the stationary exercise apparatus of FIG. 14.
Figure 16:
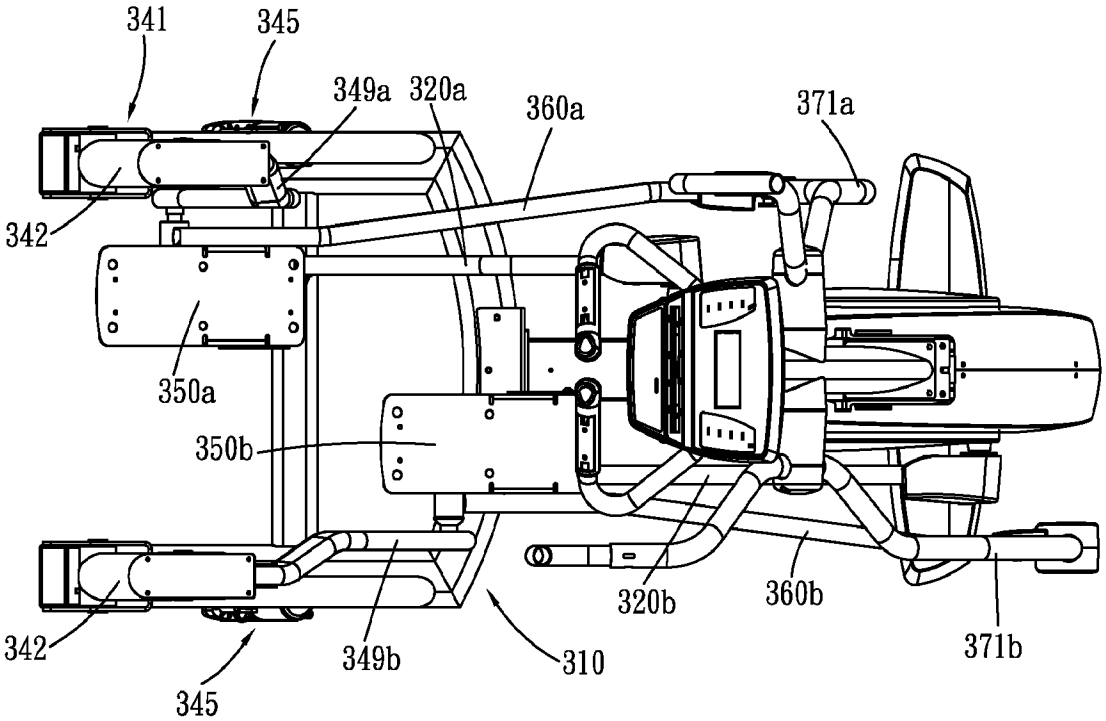
FIG. 16 is a top view of the stationary exercise apparatus of FIG. 14.

FIGS. 14 through 16 illustrate an embodiment similar to the embodiment illustrated in FIGS. 1 though 9. This third embodiment of a stationary exercise apparatus 300 includes a frame 310 having a base 311, a front portion 312, a rear portion 308, and side portions 313. The frame 310 may also include a post 314 and a standard 315. A handle assembly 380 and a console 390 are also provided as described above in relation to the first and second embodiments.

The third embodiment of the exercise apparatus 300 includes rotating members 333 that rotate about a first axis 334, similar to those described and illustrated in relation to the second embodiment 200 (FIGS. 10 through 13). An optional resistance member 135 is also provided.

Similar to the embodiment illustrated in FIGS. 1 to 9, the third embodiment of the exercise apparatus 300 also includes first and second supporting members 320*a*/320*b*, each having a first end portion 353 rotatably joined to the rotating members 333 and a second end portion 354. The second end portions 354 are respectively joined to swing members 349*a*/349*b*. The swing members 349*a*/349*b* are joined to the frame side portions 313 in a manner substantially similar to that described above in relation to the first embodiment 100.

There is also provided a moving assembly 341 including first and second moving member 342 that are defined by an upper portion 343 and a lower portion 355 joined at an elbow 356, so that the upper portion 343 and the lower portion 355 are at an angle to one another as illustrated. The first and second moving members 342 are joined to the side portions 313 via a second axis 344 to pivot as described above.

An optional adjusting assembly 345 is provided on each side of this embodiment. The adjusting assembly 345 activates the moving assembly 341 about the second axis 344. The adjusting assembly includes a motor 346, a screw rod 347, and a threaded nut, sleeve, or tube 348. The motor 346 is connected to the base 311 and to the screw rod 347. In this embodiment, the screw rod 347 is generally upright and angled slightly forward. The screw rod 347 is threaded through the tube 348, which is pivotally mounted on the lower portion 355 of the moving members 342. In this manner, the motor 346 can be activated automatically or manually from the console 390 to rotate the screw rod 347, which in turn raises or lowers the tube 348 along the screw rod 347. As the tube 348 is raised or lowered, the moving member 342 pivots about the second axis 344. A manually operated adjusting assembly could also be used, as described above.

In this embodiment of the exercise apparatus 300, the swing members 349*a*/349*b* are illustrated as arcuate in shape so that the support members 320*a*/320*b* need not extend rearwardly as far as those illustrated in previous embodiments. Otherwise, the operation of the swing member 349*a*/349*b* and the support members 320*a*/320*b* are essentially as described above.

First and second pedals 350*a*/350*b* are respectfully coupled to the first and second supporting members 320*a*/320*b*, either directly or indirectly. To couple the pedals 350*a*/350*b* indirectly to the support members 320*a*/320*b*, there are provided first and second control links 360*a*/360*b* which are pivotally connected to the support members 320*a*/320*b*. The pedals 350*a*/350*b* are joined to the control links 360*a*/360*b* and move in a second closed path when the support members 320*a*/320*b* move as described above.

Handle links 371*a*/371*b* are illustrated for this embodiment, and as with the above embodiments, may be substituted by tracks, rollers, sliders, and the like to provide support for the moving first end portions of the control links 360*a*/360*b*. Any such device is referred to herein as a "handle link" regardless of whether it actually serves as a handle for a user.

Figure 20:
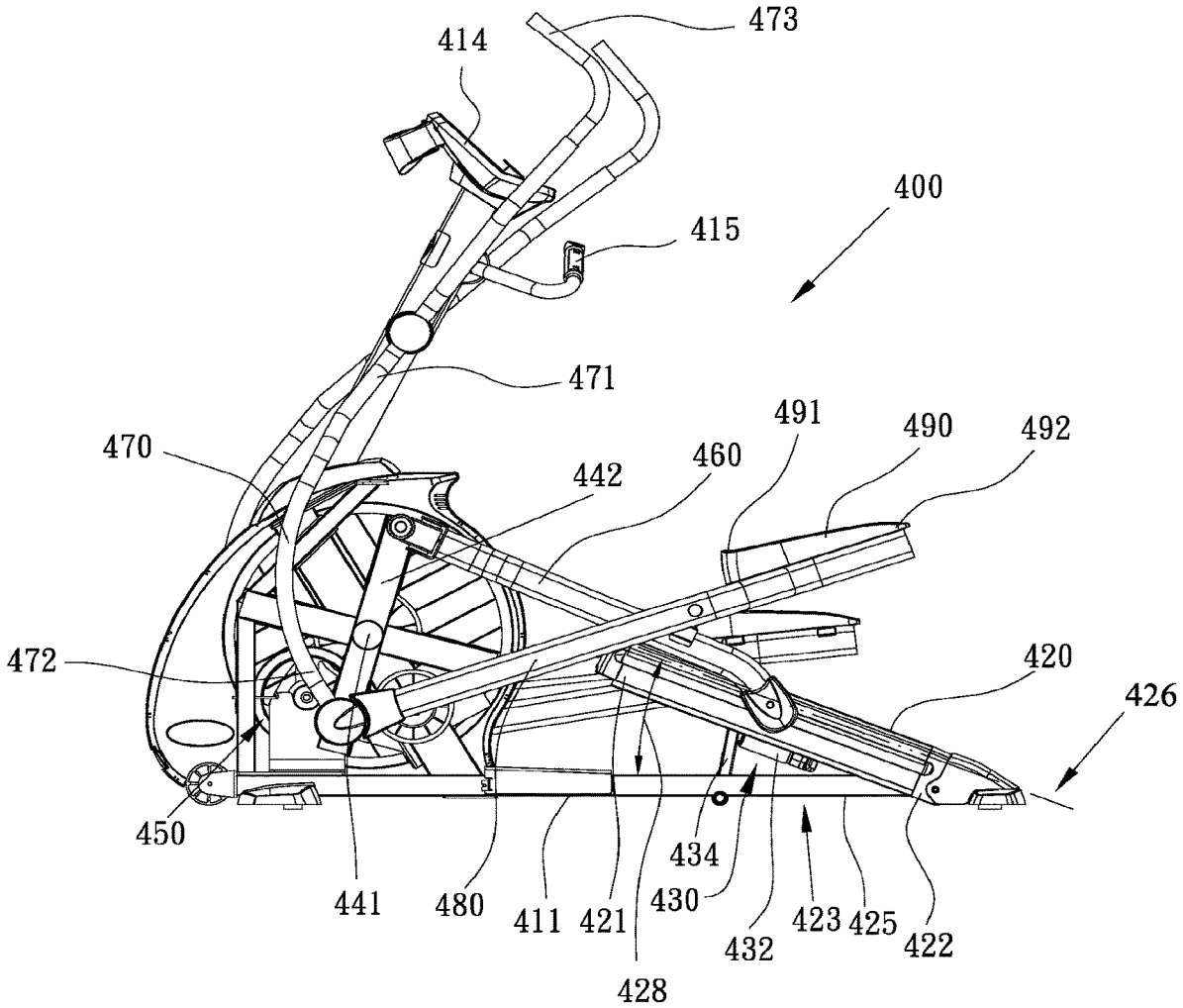
FIG. 20 is a left side view of the stationary exercise apparatus of FIG. 17 in a relatively high incline condition.
Figure 21:
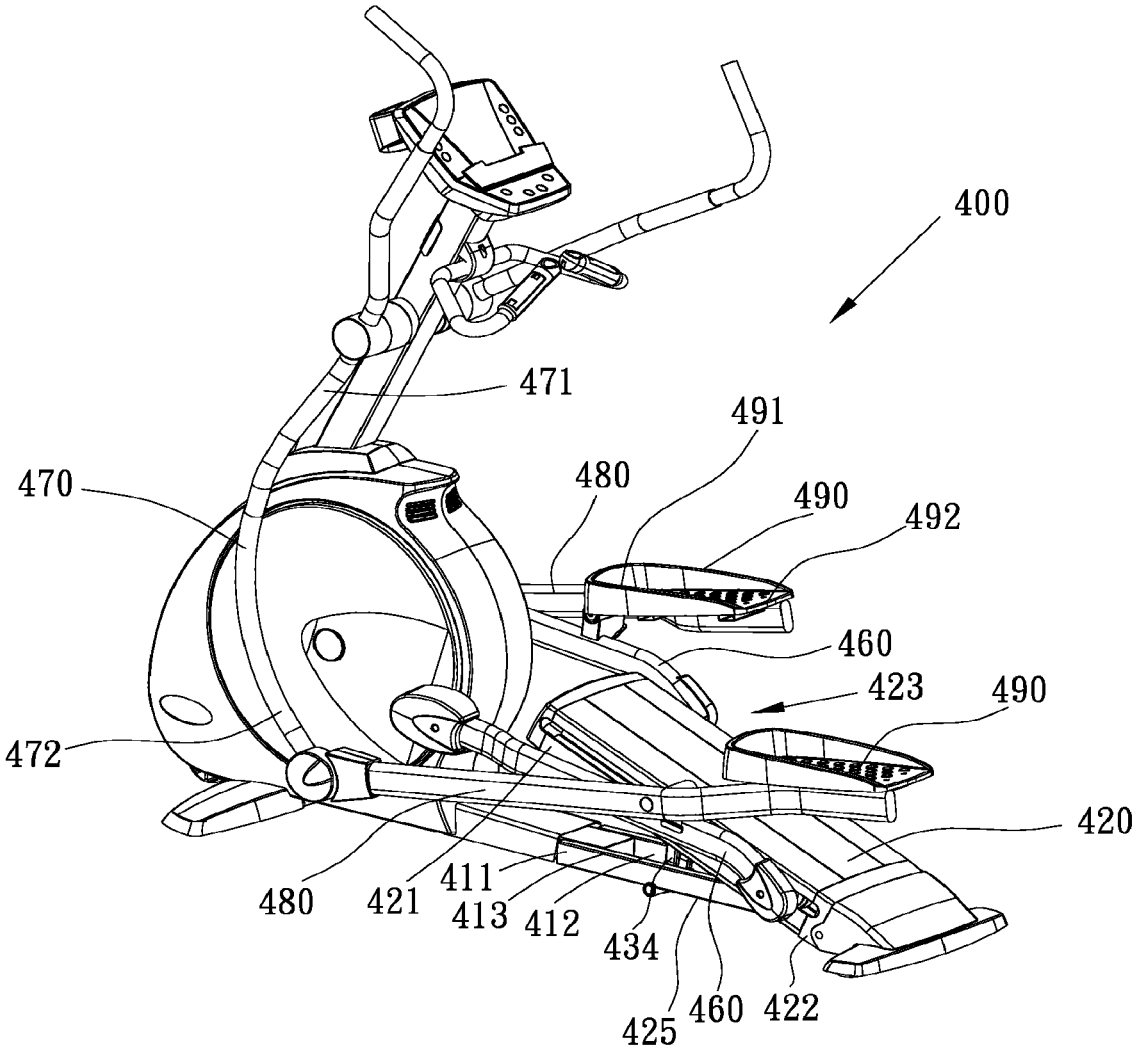
FIG. 21 is a left side perspective view of the stationary exercise apparatus of FIG. 17 in a relatively high incline condition.

FIGS. 17 through 21 illustrate an embodiment having substantial portion similar to the embodiments illustrated in FIGS. 1 though 16. This fourth embodiment of a stationary exercise apparatus 400 includes a frame 410 having a base and a rear portion 425 (FIG. 20). The frame 410 may also include a front portion having a post 412 and a standard 413. A fixed handle assembly 415 and a console 414 are also provided as described above in relation to the previous embodiments.

The fourth embodiment of the exercise apparatus 400 includes rotating members 418 that rotate about a first axis 441, similar to those described and illustrated in relation to the second embodiment 200 (FIGS. 10 through 13). An optional resistance assembly 450 is also provided.

Similar to the embodiment illustrated in FIGS. 1 to 9, the fourth embodiment of the exercise apparatus 400 also includes first and second supporting members 460, each having a first end portion 461 rotatably joined to the rotating members 418 and a second end portion 463. Preferably, the second end portion is coupled with some rollers or sliders for reciprocating movement on a surface such as a track surface. The second end portions 463 of the first and second supporting members 460 are respectively reciprocated on a guider assembly 423 which is coupled to the rear portion 425 of the base 411. There is more detail description of the guider assembly 423 hereinafter.

Figure 22:
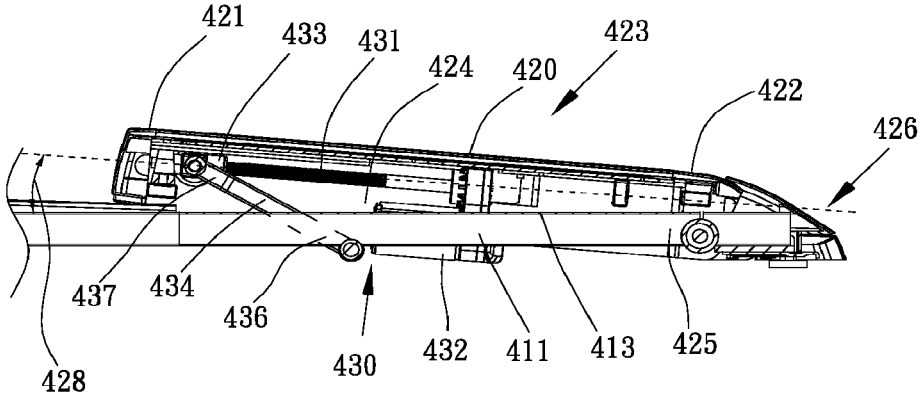
FIG. 22 is a left side view of the guide assembly of the stationary exercise apparatus of FIG. 17 in a relatively low incline condition.
Figure 23:
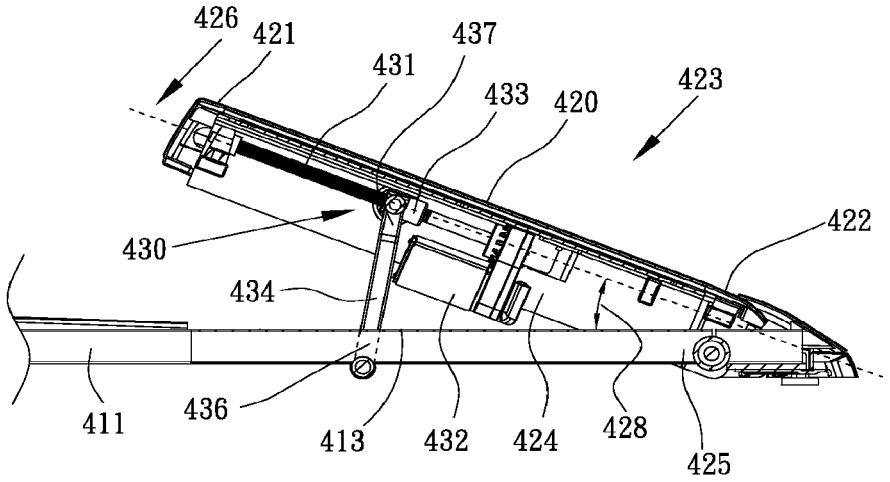
FIG. 23 is a left side view of the guide assembly of the stationary exercise apparatus of FIG. 17 in a relatively high incline condition.

Now referring to FIGS. 22 and 23, the guider assembly 423 comprises a guider 420 coupled to the rear portion 425 of the base 411 and a moving member 434 movably coupled between the guider 420 and the base 411. The guider 420 has a first end portion 421, and a second end portion 422 pivotally connected to the base 411. A reciprocating path 426 is defined between the first and second end portions 421/422 of the guider 420. In the embodiment illustrated in FIGS. 17 through 21, the guider 420 is a linear track to define the reciprocating path 426 substantially parallel to the surface of the guider 420. In other embodiments, the guider 420 could be a curved track (not shown), the reciprocating path 426 is a virtual linear line connecting first and second ends of the curved track. An incline angle 428 is defined by the reciprocating path 426 and the base 411 in both linear and curved track embodiments. More specifically, the incline angle 428 is defined by the reciprocating path 426 and the top horizontal surface of the base 411, or a ground surface on which the base 411 rests.

Figure 24:
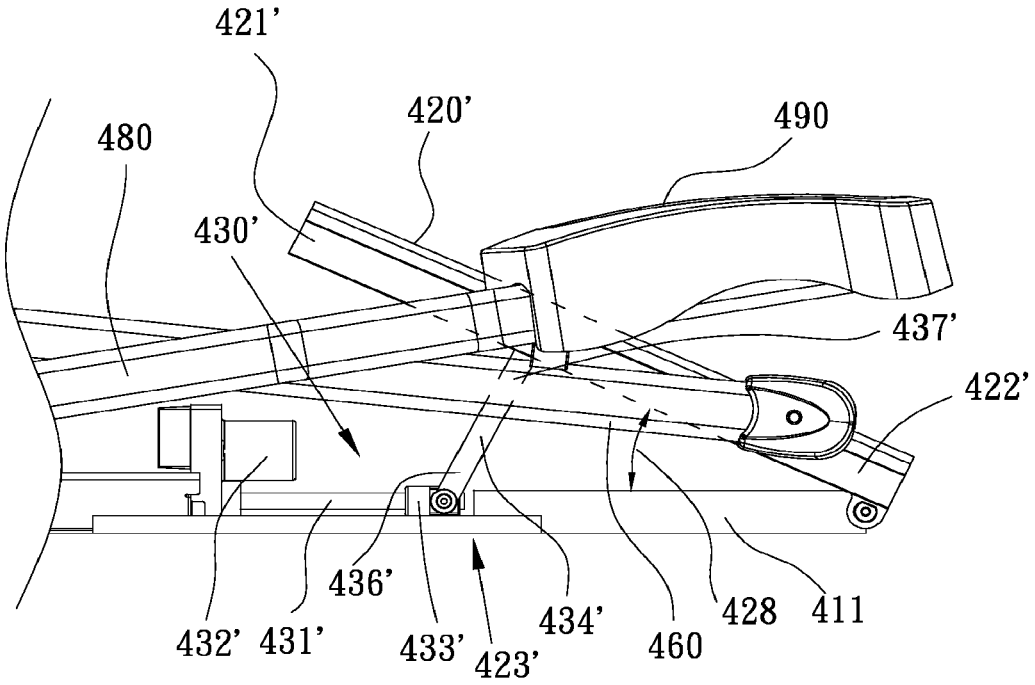
FIG. 24 is a left side view of an alternative embodiment of the guide assembly of the stationary exercise apparatus of FIG. 17 in a relatively high incline condition.

FIGS. 22 through 24 illustrate detailed views of the guider assembly 423 and an alternative embodiment of the guider assembly 423. In FIG. 22, the guider 420 is in a relatively low incline condition and the incline angle 428 defined by the guider 420 and the base 411 is about 5 degrees. The moving member 434 has a first end portion 436 pivotally connected to the base 411, and a second end portion 437 movably coupled to the guider 420. In FIG. 23, the second end portion 437 of the moving member 434 is selectively coupled to the guider 420 close to a middle position between the first and second end portions 421/422 of the guider 420. In the arrangement of FIG. 23, the moving member 434 is inclined further upwardly, and the incline angle 428 is increased to about 22 degrees. The exercise apparatus 400 is in a relatively high incline condition when the incline angle 428 is about 22 degrees.

An optional adjusting assembly 430 is provided under the guider 420 in the embodiment shown in FIGS. 22 and 23. The adjusting assembly 430 activates the moving member 434 electronically to vary the incline angle 428. The adjusting assembly 430 includes a motor 432, a screw rod 431, and a threaded nut, sleeve, or tube 433. The motor 432 is connected to the screw rod 431 for driving the screw rod 431. In this embodiment, the screw rod 431 is mounted under the guider 420 in an orientation generally parallel to the reciprocating path 426. The screw rod 431 is threaded through the tube 433, which is pivotally mounted on the second end portion 437 of the moving member 434. In this manner, the motor 432 can be activated automatically or manually from the console 414 to rotate the screw rod 431, which in turn pushes or pulls the tube 433 along the screw rod 431. As the tube 433 is pushed or pulled, the second end portion 437 of the moving member 434 is movably coupled between the guider 420 and the base 411. A manually operated adjusting assembly could also be used, as described above.

The guider assembly 423' shown in FIG. 24 is an alternative embodiment of the guider assembly 423 shown in FIGS. 22 and 23. The guider assembly 423' also includes a guider 420' coupled to the base 411, and a moving member 434' having a first end portion 436' movably coupled to the base 411, and a second end portion 437' pivotally connected to the guider 420'. In FIG. 24, the first end portion 436' of the moving member 434' is selectively coupled to the base 411 and the second end portion 437' is pivotally connected to the guider 420' closed to a middle position of the guider 420'. The middle position is between first second end portions 421'/422' of the guider 420'. There is also an optional adjusting assembly 430' mounted on the base 411. Similar to what is described previously; the adjusting assembly 430' can also activate the moving member 434' to vary the incline angle 428.

There are also other alternative embodiments of the guider assembly 423' shown in FIG. 24. For example, the screw rod 431' could be replaced by a bracket mounting on the base 411 with several receiving notches positioned substantially horizontally. Then, the first end portion 436' of the moving member 434' could selectively be coupled to one of the receiving notches by manual operation of a user in order to vary the incline angle 428. Another example is that the moving member 434' comprises a pair of telescopic tubes which can be contracted or expanded to each other when the incline angle 428 is decreased or increased. In the embodiment of the telescopic tubes, both first and second end portions 436'/437' of the moving member 434' are pivotally connected to the base 411 and the guider 420'. The telescopic tubes could be selectively locked to each other for different incline angles of the guider 420'.

In addition to the benefits described in the previous embodiments shown in FIGS. 1 through 16, the embodiments shown in FIGS. 17 through 24 further have the following advantages. Substantial portions of both the moving member 434 and adjusting assembly 430 could be hidden by the base 411 and the guider assembly 423 which further comprises a shroud 424 (FIG. 23) when the incline angle 428 is in the condition of FIG. 19 or 22, the relative low incline condition. Therefore, appearance of the stationary exercise apparatus 400 is more compact and succinct in the relative low incline condition. Further, the positioning of the adjusting assembly 430 under the guider 420 permits a more compact appearance, while allowing for efficient transfer of mechanical force from the adjusting assembly 430 to the guider 420. Also, in a preferred embodiment, the base 411 can include an access hatch 412 to permit ready access to the adjusting assembly 430 and the guider 420. The access hatch 412 is located below the top surface 413 of the base 411 in order to access or hide some portion of the adjusting assembly 430 and the moving member 434 when the guider 420 is at the lowest incline condition as shown in FIG. 22.

Figure 17:
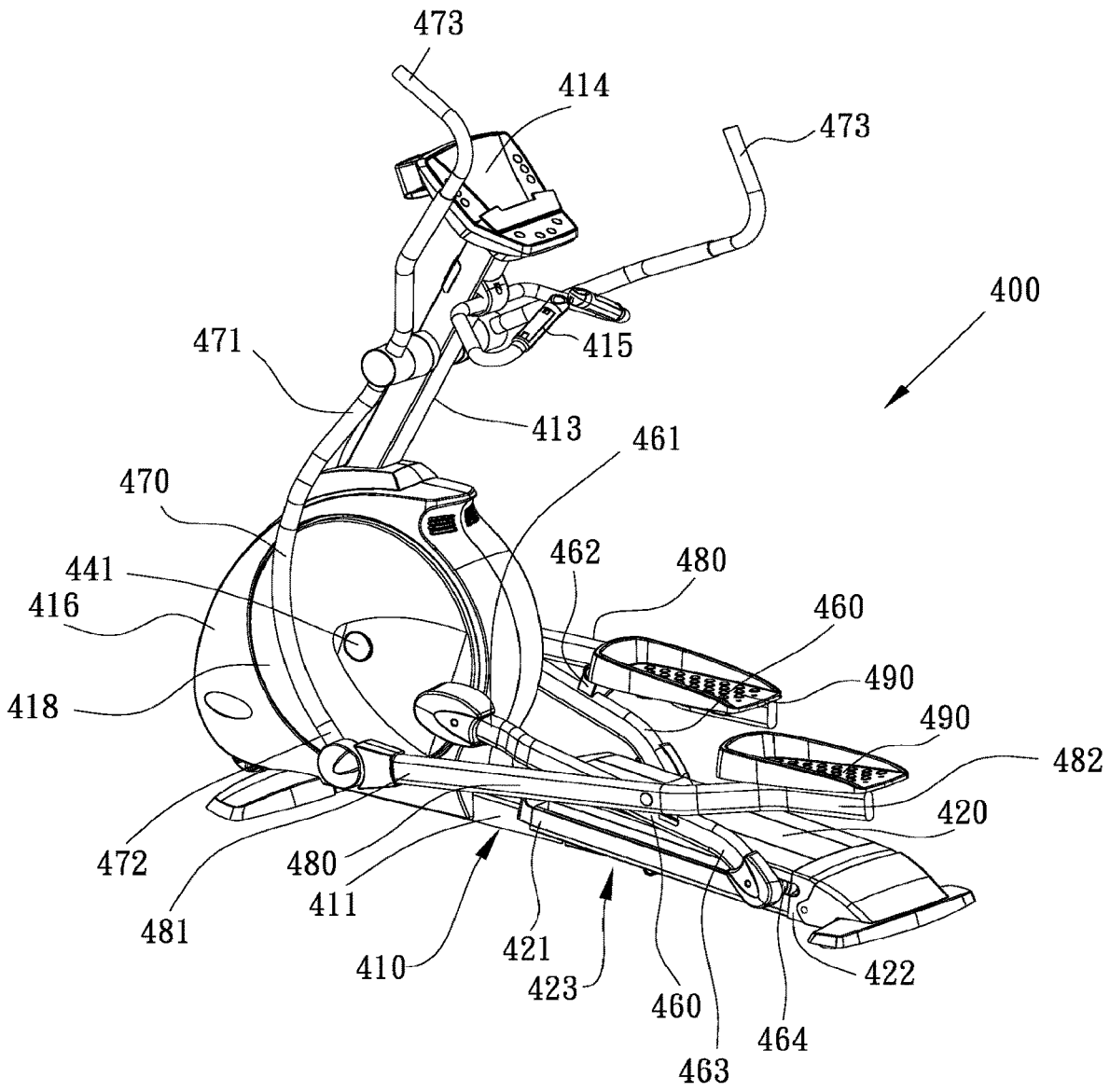
FIG. 17 is a left side perspective view of a fourth embodiment of a stationary exercise device in accordance with the present invention.
Figure 18:
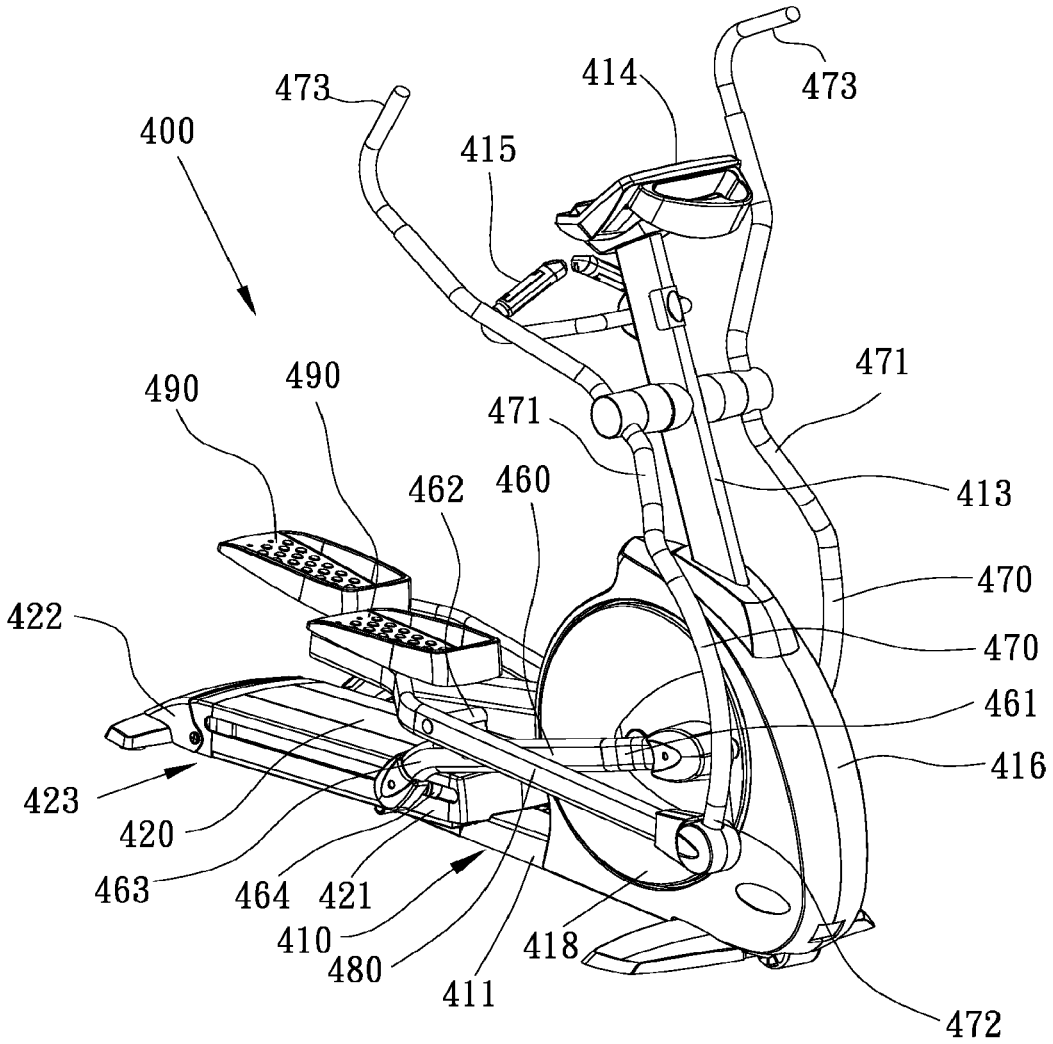
FIG. 18 is a right side perspective view of the stationary exercise apparatus of FIG. 17.
Figure 19:
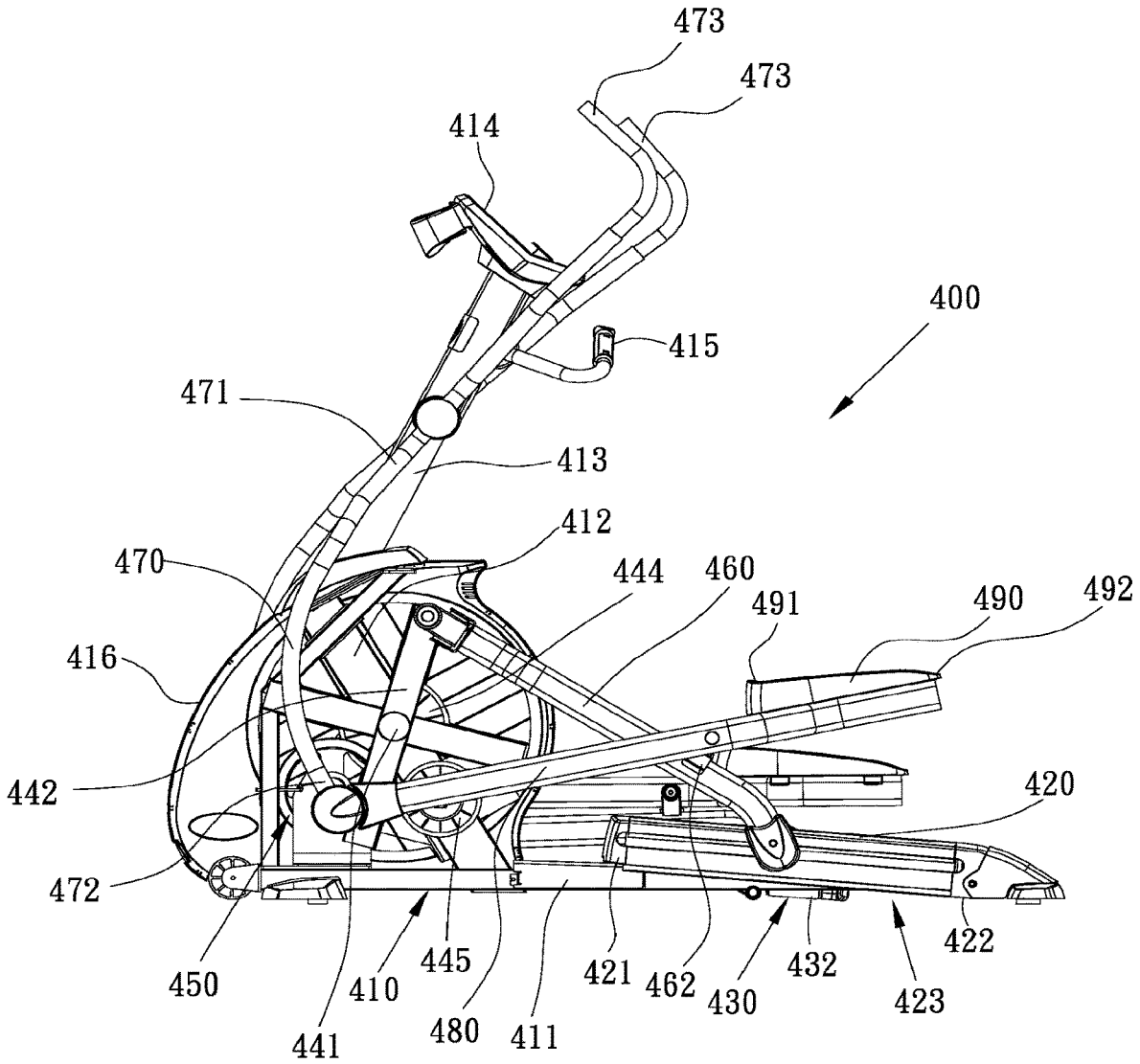
FIG. 19 is a left side view of the stationary exercise apparatus of FIG. 17 in a relatively low incline condition.

Now referring to FIGS. 17 and 20, first and second pedals 490 are respectively coupled to the first and second supporting members 460, either directly or indirectly as described above. Each of the pedals 490 respectively has a front end portion 491 and a rear end portion 492. To couple the pedals 490 indirectly to the support members 460, there are provided first and second control links 480 which are pivotally connected to the supporting members 460. The pedals 490 are joined to the control links 480 and move in a second closed loop path 498 and a third closed loop path 497 when the supporting members 460 move as described above.

Handle links 470 are illustrated for this embodiment, and as with the above embodiments, may be substituted by tracks, rollers, sliders, and the like to provide support for the moving first end portions 481 of the control links 480. Any such device is referred to herein as a "handle link" regardless of whether it actually serves as a handle for a user.

Figure 25:
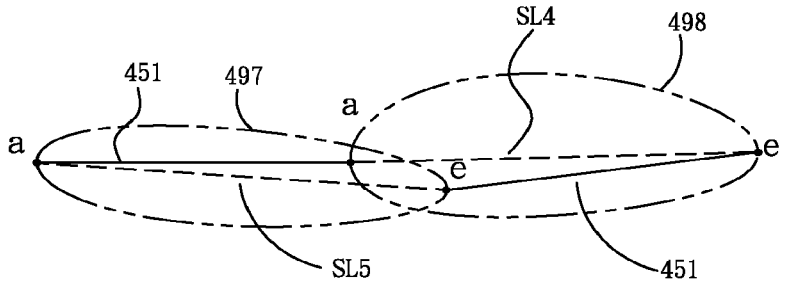
FIG. 25 are toe and heel path profiles of the stationary exercise apparatus of FIG. 17 in a relatively low incline condition.
Figure 26:
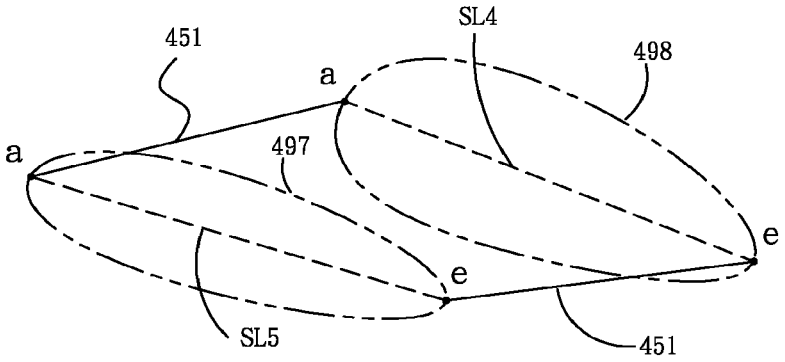
FIG. 26 are toe and heel path profiles of the stationary exercise apparatus of FIG. 17 in a relatively high incline condition.

FIGS. 25 and 26 are path profiles and information of the stationary exercise apparatus 400 when the guider 420 is in the relatively low and high incline conditions. The points a and e are also correspondent to the foremost and rearmost positions when the first ends of the first and second supporting members 460 are rotating about the first axis 441. Similar to described above, second and third closed loop paths 498/497 are respectively representing the moving paths of the heel and toe portions of a user of the stationary exercise apparatus 400; stride lengths SL4 and SL5 are respectively representing the stride lengths of the heel and toe portions of a user of the stationary exercise apparatus 400 similar to the description of FIG. 9.

Stride length is relative to exercise intensity and a longer stride length generally results in higher exercise intensity. In FIG. 25, the stride length SL4 is substantially same with the stride length SL5. But, comparing the stride length SL4 with the stride length SL5 in FIG. 26, the stride length SL4 is longer than the stride length SL5 when the stationary exercise apparatus 400 is in the relatively high incline condition. That is, the length of the stride length SL4 is greater than the length of the stride length SL5 when the guider 420 is adjusted from a relatively low incline condition to a relatively high incline condition. Therefore, the heel portion and gluteus portion of a user are having higher exercise intensity when the stationary exercise apparatus 400 is in the relatively high incline condition.

The orientation of the pedals 490 can be simply illustrated by a pedal orientation 451 as shown in FIGS. 25 and 26, a connection between the front and rear ends of the pedals 490. One important character of the pedal orientation 451, in the foremost position a, is that the steepness of the pedal orientation 451 is increased forwardly when the guider 420 is adjusted from the relatively low incline condition to the relative high incline condition. That is, in the foremost position a, the rear end portion 492 is moved upwardly at a faster rate than the front end portion 491 of the pedals 490 when the guider 420 is adjusted from the relatively low incline condition to the relative high incline condition. Simply speaking, in the foremost position a, the rear end portion 492 is moved higher than the front end portion 491 of the pedals 490 when the incline angle 428 is increased. Since the steepness, in the foremost position a, of the pedal orientation 451 is more obvious in the relatively high incline condition, the heel portion of a user is elevated more obvious than the toe portion of a user, therefore the gluteus of the user could be fully exercised as described above.

The previously described embodiments of the present invention have many advantages, including: (a) to provide a user of the stationary exercise apparatus with a benefit of high exercise intensity; (b) to provide a user of the stationary exercise apparatus with a benefit of an inclined foot path; (c) to provide a user of the stationary exercise apparatus with a benefit of an increased stride length; and (d) to provide a user of the stationary exercise apparatus with a benefit of better gluteus exercise; (e) to provide the stationary exercise apparatus with a more compact and succinct appearance. The present invention does not require that all the advantageous features and all the advantages need to be incorporated into every embodiment thereof. Although the present invention has been described in considerable detail with reference to certain preferred embodiment thereof, other embodiments are possible. Therefore, the spirit and scope of the appended claims should not be limited to the description of the preferred embodiment contained herein.

The invention claimed is:

1. A stationary exercise apparatus, comprising:

a frame having a front portion and a rear portion;

a guider operatively engaged with the rear portion of the frame, and defining a first reciprocating path and a second reciprocating path that is substantially parallel to the first reciprocating path at an adjustable incline angle;

a first supporting member having a first end portion and a second end portion, and the first end portion of the first supporting member is operatively engaged with the frame to rotate about a first axis, and the second end portion of the first supporting member is operatively engaged with the guider for movement in the first reciprocating path;

a second supporting member having a first end portion and a second end portion, and the first end portion of the second supporting member is operatively engaged with the frame to rotate about the first axis, and the second end portion of the second supporting member is operatively engaged with the guider for movement in the second reciprocating path;

a first pedal operatively engaged with the first supporting member at a location between the first end portion and the second end portion;

a second pedal operatively engaged with the second supporting member at a location between the first end portion and the second end portion; and an adjusting assembly operatively engaged with the guider to adjust the incline angle.

2. The stationary exercise apparatus of claim 1, wherein the adjusting assembly is completely supported by the frame.

3. The stationary exercise apparatus of claim 1, wherein the adjusting assembly is at least partially supported by the frame.

4. The stationary exercise apparatus of claim 1, wherein the adjusting assembly is at least partially supported by the guider.

5. The stationary exercise apparatus of claim 1, wherein the adjusting assembly comprises:

a first pivot joined to the frame.

6. The stationary exercise apparatus of claim 1, and further comprising:

a moving member operatively joined to the adjusting assembly.

7. The stationary exercise apparatus of claim 1, and further comprising:

a moving member operatively joined to the guider.

8. The stationary exercise apparatus of claim 1, wherein the adjusting assembly comprises:

a motor; and an elongate member operatively mounted between the motor and the guider; and the stationary exercise apparatus further comprises:

a moving member operatively engaged with the elongate member to at least partially support the guider at a plurality of incline angles.

9. The stationary exercise apparatus of claim 1, wherein the adjusting assembly comprises:

a motor at least partially supported by the guider; and an elongate member operatively joined to the motor; and the stationary exercise apparatus further comprises:

a moving member operatively engaged with the elongate member to at least partially support the guider at a plurality of incline angles.

10. The stationary exercise apparatus of claim 1, wherein the adjuster assembly comprises:

a motor; and an elongate member operatively engaged with the motor and the guider; and the stationary exercise apparatus further comprises:

a moving member operatively engaged with the elongate member for movement relative to the guider.

11. The stationary exercise apparatus of claim 1, wherein the adjuster assembly comprises:

a motor at least partially supported by the guider; and an elongate member operatively engaged with the motor and the guider; and the stationary exercise apparatus further comprises:

a moving member operatively engaged with the guider for movement relative to the guider.

12. The stationary exercise apparatus of claim 1, wherein the adjusting assembly comprises:

an elongate member operatively engaged with the guider; and the stationary exercise apparatus further comprises:

a moving member operatively engaged with the elongate member and the guider for movement relative to the guider.

* * * * *